US009016966B2

(12) United States Patent
Fujita et al.

(10) Patent No.: US 9,016,966 B2
(45) Date of Patent: Apr. 28, 2015

(54) PRINTER WITH PAPER HOLDER HAVING PAPER NEAR-END DETECTOR

(71) Applicants: Citizen Holdings Co., Ltd., Tokyo (JP); Citizen Systems Japan Co., Ltd., Tokyo (JP)

(72) Inventors: Hirotaka Fujita, Kodaira (JP); Hiroyuki Tsugaru, Tokorozawa (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 0 days.

(21) Appl. No.: 13/945,329

(22) Filed: Jul. 18, 2013

(65) Prior Publication Data

US 2014/0023420 A1 Jan. 23, 2014

(30) Foreign Application Priority Data

Jul. 20, 2012 (JP) ..... 2012-161584

(51) Int. Cl.

| | |
|---|---|
| ***B41J 29/48*** | (2006.01) |
| ***B65H 26/08*** | (2006.01) |
| ***B41J 15/04*** | (2006.01) |
| ***B41J 11/00*** | (2006.01) |

(52) U.S. Cl.

CPC ..... *B41J 15/04* (2013.01); *B65H 26/08* (2013.01); *B65H 2301/41522* (2013.01); *B41J 29/48* (2013.01); *B41J 11/0075* (2013.01); *B41J 15/042* (2013.01)

(58) Field of Classification Search

CPC ..... B41J 15/042; B41J 11/0075; B41J 29/48; B65H 2301/41522; B65H 26/08

USPC ..... 400/613, 703, 706, 708, 76; 242/563, 242/563.1, 563.2, 912

See application file for complete search history.

(56) References Cited

U.S. PATENT DOCUMENTS

| | | | | | |
|---|---|---|---|---|---|
| 5,820,068 | A | * | 10/1998 | Hosomi et al. | 242/563 |
| 2004/0234316 | A1 | * | 11/2004 | Matsuse | 400/613 |

FOREIGN PATENT DOCUMENTS

| | | | | | |
|---|---|---|---|---|---|
| JP | 56-128264 | | | 9/1981 | |
| JP | 2004181768 | A | * | 7/2004 | B41J 15/04 |
| JP | 2007008624 | A | * | 1/2007 | B65H 18/04 |

* cited by examiner

*Primary Examiner* — Daniel J Colilla

(74) *Attorney, Agent, or Firm* — Wenderoth, Lind & Ponack, L.L.P.

(57) ABSTRACT

A printer includes a paper holder which includes a shaft portion for supporting roll paper, and a movable member in a predetermined vertical height position near and above a first end portion of the shaft portion. The movable member is configured to be displaced along an extending direction of the shaft portion between a pressing position, in which the movable member is brought into contact with and pressed against an end surface of the roll paper supported by the shaft portion, and a non-pressing position, in which the movable member is not in contact with the end surface of the roll paper. The movable member is also biased toward the non-pressing position. A movable member detector is configured to detect that the movable member is in the non-pressing position, and a remaining amount notifier is configured to notify that a remaining amount of the roll paper is low.

7 Claims, 17 Drawing Sheets

SECT. A-A

FIRST POSITION

SECOND POSITION

THIRD POSITION

FOURTH POSITION

PRINTER WITH PAPER HOLDER HAVING PAPER NEAR-END DETECTOR

PRIORITY CLAIM

The present application is based on and claims priority from Japanese Patent Application No. 2012-161584, filed on Jul. 20, 2012, the disclosure of which is hereby incorporated by reference in its entirety.

BACKGROUND

1. Field of the Invention

The present invention relates to a printer, and, more specifically, to an improvement in paper-near-end detection which is used for giving notification when a remaining amount of rolled-up paper (roll paper) becomes low.

2. Description of the Related Art

To implement paper-near-end detection in a conventional printer of a type in which roll paper is hung by a shaft of a paper holder to be supported in a housing for the roller paper (a paper housing), the printer is provided with: a turnable lever in the paper housing, the turnable member being capable of rotationally moving between a pressing position in which the turnable lever is brought into contact with the roll paper and a non-pressing position in which the turnable lever is separated from the roll paper, and biased toward the non-pressing position by a spring or the like; and a detector to detect that the turnable lever is in the non-pressing position.

The turnable lever and the detector are both provided in a printer body.

The turnable lever is biased to be positioned in the non-pressing position. When the turnable lever is brought into contact with a predetermined position in an end surface of the roll paper housed in the paper housing, the turnable lever is turned to the pressing position as a result of being pressed by the roll paper.

The predetermined position of the roll paper with which the turnable lever is brought into contact is set to be a position separated by a predetermined distance (a predetermined rolling radius) from the center portion of the roll paper in the radius direction.

As a result, when the remaining amount of the roll paper is large and the rolling radius is sufficiently large, the turnable lever is in the pressing position while being brought into contact with the end surface of the roll paper. On the other hand, when the remaining amount of the roll paper becomes low and the rolling radius becomes small, the turnable lever is separated from the end surface of the roll paper and is biased and rotationally moved to the non-pressing position. Then, the detector detects the non-pressing position of the turnable lever. As a result of this detection, notification of the remaining amount of paper and the like are made (Japanese Utility Model Application Laid-open Publication No. 56-128264).

Meanwhile, the related art described in Japanese Utility Model Application Laid-open Publication No. 56-128264 has a problem that the structure of a printer body becomes complicated because the turnable lever and the detector are integrally provided in the printer body.

SUMMARY

The present invention has been made in consideration of the foregoing problem, and an object of the present invention is to provide a printer capable of detecting a paper-near-end without providing a complex structure to the printer body and without impairing the operability of a printer when a paper holder is attached or detached with respect to a printer body.

In the printer according to the present invention, a movable member being displaced according to a remaining amount of paper is provided in a paper holder detachable with respect to a printer body and a movable member detector to detect a position of the movable member when the paper holder is set in the printer body is provided in the printer body, so that a complex structure does not need to be provided to the printer body and the operability when the paper holder is detached or attached with respect to the printer body is not impaired.

Specifically, the printer according to the present invention comprises: a paper holder which includes a shaft portion for supporting roll paper and a movable member in a predetermined vertical height position near and above one end portion of the shaft portion, the movable member being configured to be displaced along an extending direction of the shaft portion between a pressing position in which the movable member is brought into contact with and pressed against an end surface of the roll paper supported by the shaft portion and a non-pressing position in which the movable member is not in contact with the end surface of the roll paper, the movable member being biased toward the non-pressing position; a movable member detector configured to detect that the movable member is in the non-pressing position with the paper holder being attached to the printer body, the movable member detector being provided in the printer body; and a remaining amount notifier configured to notify that a remaining amount of the roll paper is low when the movable member detector detects that the movable member is in the non-pressing position.

BRIEF DESCRIPTION OF THE DRAWINGS

The accompanying drawings are included to provide further understanding of the present disclosure, and are incorporated in and constitute a part of this specification. The drawings illustrate embodiments of the present disclosure and, together with the specification, serve to explain the principle of the present disclosure.

FIGS. 4A and 4B are both drawings, each illustrating the printer with the cover being closed, in which FIG. 4A is a front view thereof and FIG. 4B is a cross-sectional view taken by a plane along the A-A line in FIG. 4A;

FIGS. 9A and 9B are drawings, each illustrating a positional relationship between a movable member and a photosensor, in which FIG. 9A shows a state where the remaining amount of paper is sufficient, equivalent to FIG. 7, and FIG. 9B shows a state where the remaining amount of paper is low, equivalent to FIG. 8;

FIGS. 17A, 17B, 17C, and 17D respectively show the first, second, third, and fourth positions.

DESCRIPTION OF THE PREFERRED EMBODIMENTS

Hereinafter, a specific embodiment of a printer according to the present invention is described with reference to the drawings.

Figure 1:
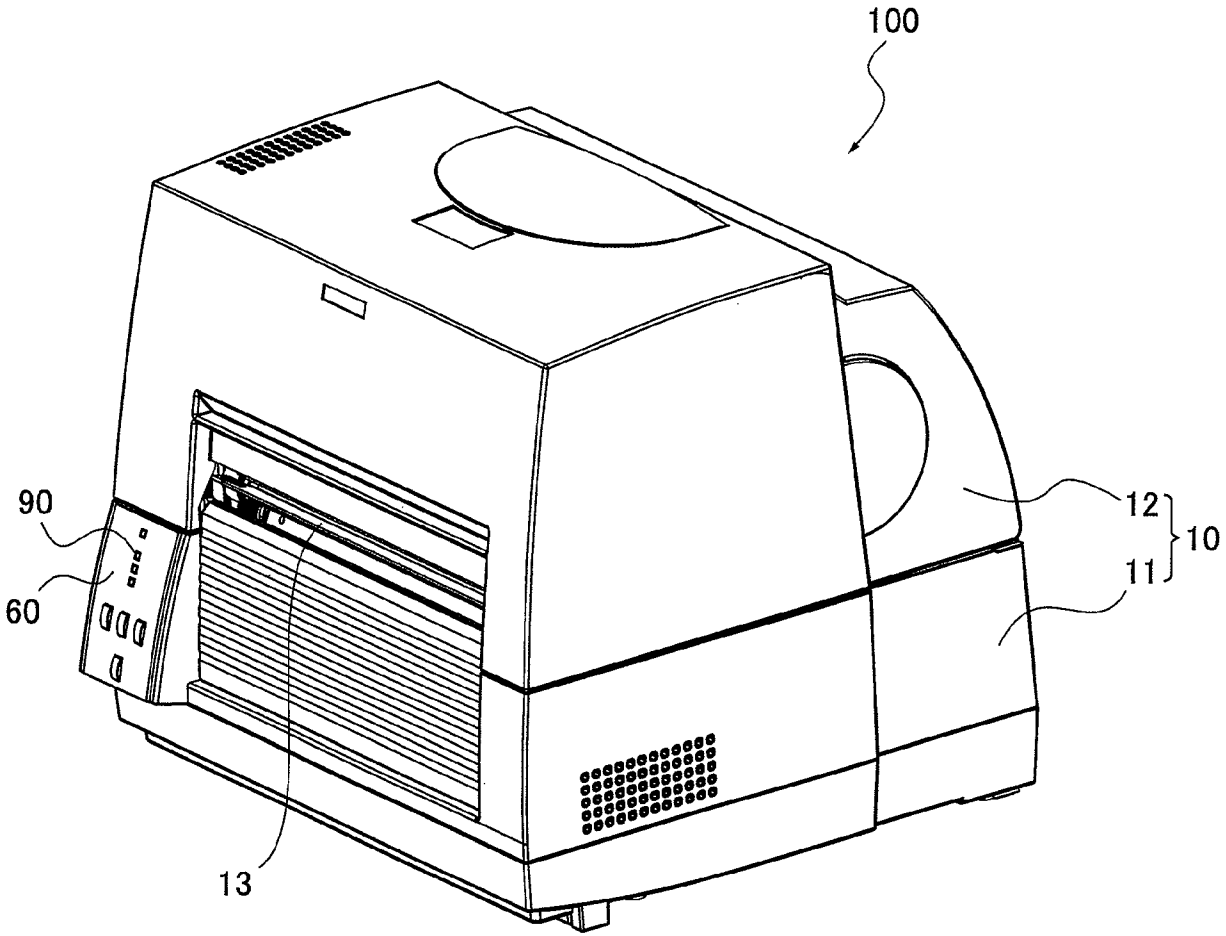
FIG. 1 is a perspective view illustrating an outer shape of an ink-ribbon-mounted label printer as an embodiment of a printer according to the present invention.

A printer according to an embodiment of the present invention shown in FIG. 1 is a label printer 100 including an ink ribbon (hereinafter, simply referred to as a printer 100).

Figure 2:
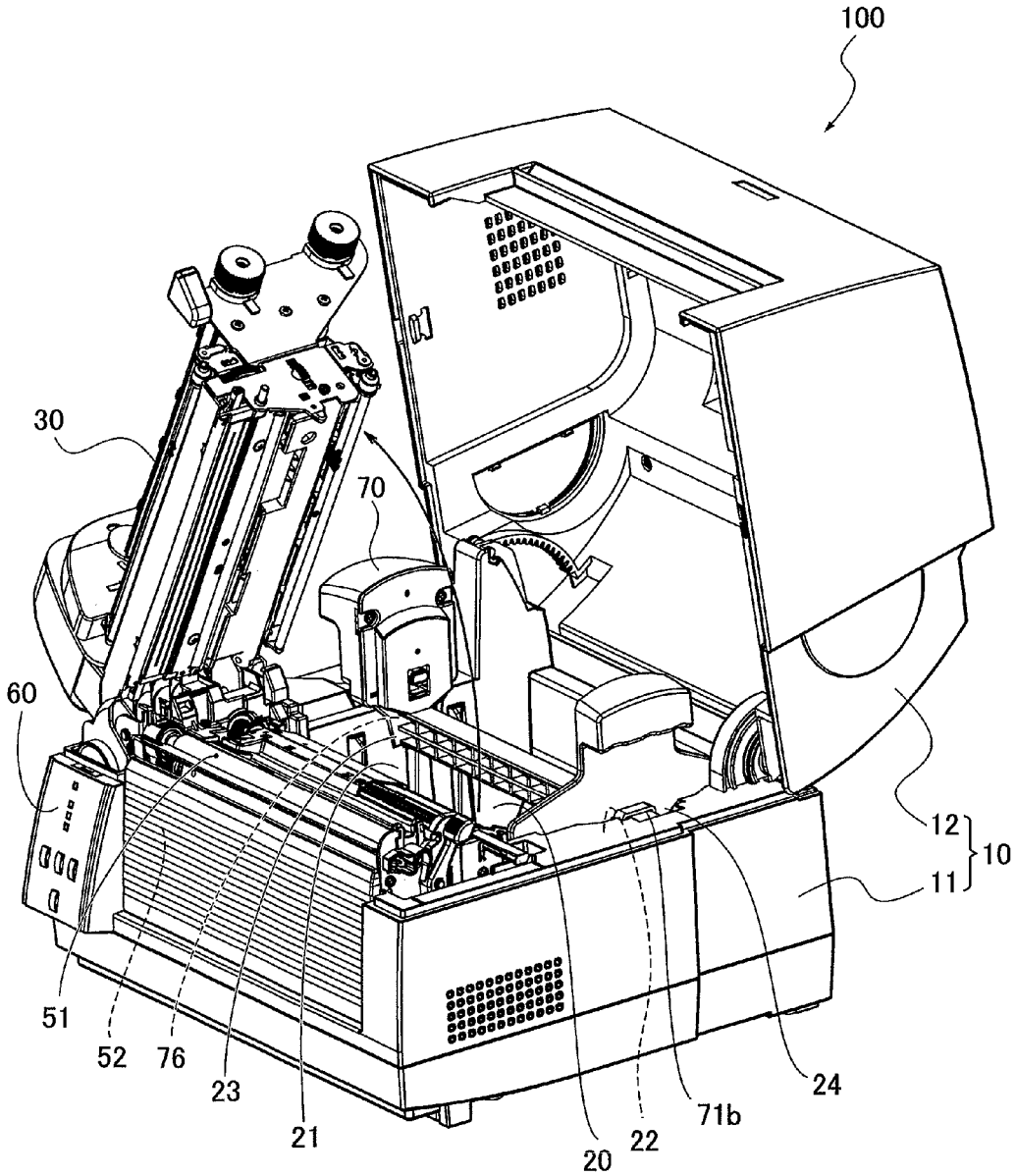
FIG. 2 is a perspective view illustrating the printer shown in FIG. 1 with a cover being opened.

As shown in FIG. 2, in the printer 100, a cover 12 of a casing 10 can be opened by backwardly rotationally moving the cover 12 with respect to a body 11 (a printer body) of the casing 10. A paper housing 20 is formed inside the casing 10 with the cover 12 being opened.

The paper housing 20 is a space in which paper to be printed by the printer 100 is housed. An example of the paper includes, for example, roll paper 200 (hereinafter, simply referred to as paper 200) as shown in FIG. 3, to which labels are affixed at predetermined intervals on a long strip-shaped paper liner and which is rolled in a cylindrical shape as a whole.

The paper 200 is designed such that printing is made on a label portion.

Figure 3:
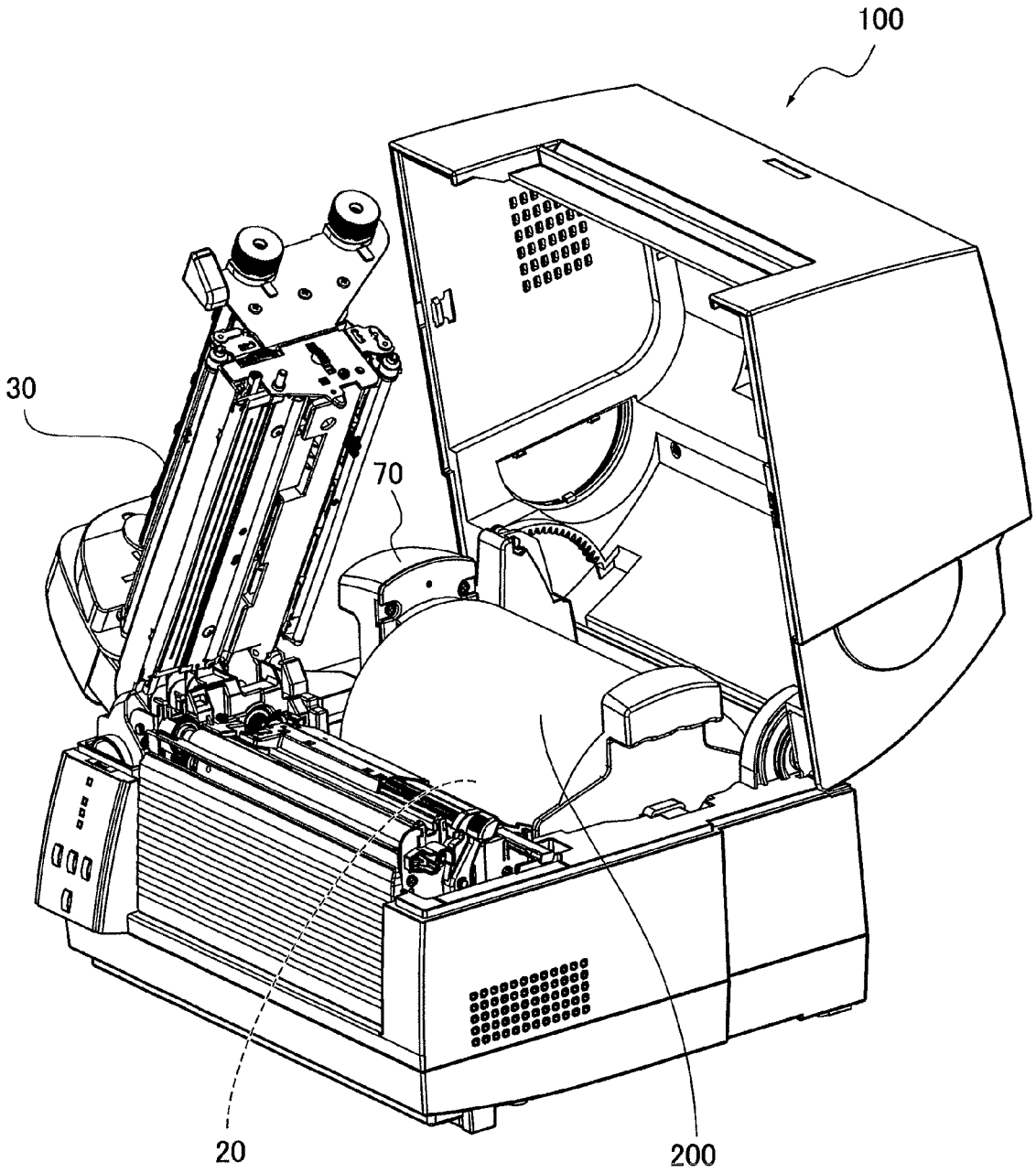
FIG. 3 is a perspective view equivalent to FIG. 2 illustrating a state in which roll paper is housed.

The paper housing 20 is accessible in the state where the cover 12 is opened as shown in FIGS. 2 and 3. In this state, the paper 200 set in a paper holder 70 to be described later can be housed or a remaining core of the paper 200 can be removed.

A positioning receptive portion 23 is formed in a wall portion 21 on one side of the paper housing 20 and is to be a positioning reference for disposing the paper holder 70 along the extending direction (an axial direction) and vertical direction of a shaft portion 71 to be described later. Also, a receptive portion 24 is formed in a wall portion 22 on the other side and serves as a positioning reference for disposing the shaft portion 71 along the vertical direction.

Then, after the paper 200 is housed in the paper housing 20, the cover 12 is rotationally moved to the front side to be closed as shown in FIG. 1, and printing or the like is performed onto the paper 200.

Figure 4B:
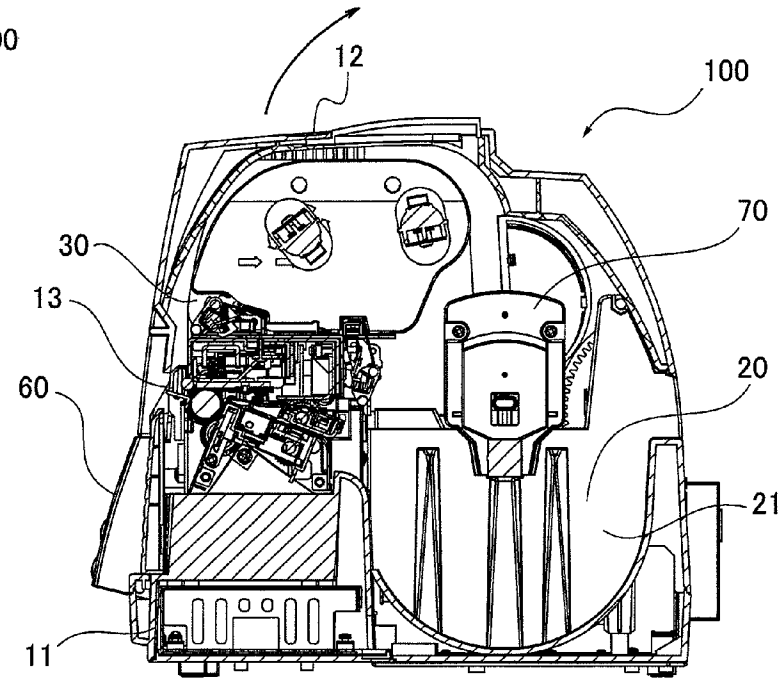
Figure 4A:
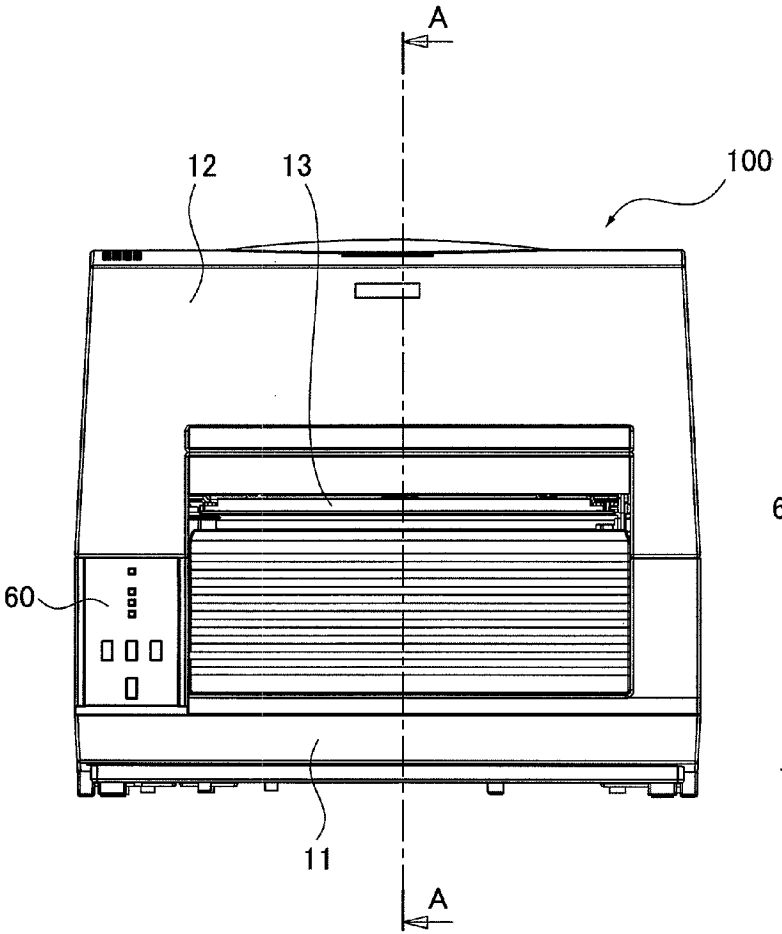

Here, FIGS. 2 and 3 show a state where the printing unit 30 including an ink ribbon (not illustrated) is lifted up. However, in the state where the cover 12 shown in FIG. 1 is closed, the printing unit 30 is lowered as shown in FIG. 4B.

As shown in FIG. 1, a discharge port 13 from which the paper 200 is discharged is formed and opened in the front side of the casing 10.

Also, an operation unit 60 is provided on the front side of the casing 10. The operation unit 60 includes button switches to input various kinds of operational instructions or lamps to visually illuminate a power state, notification, warning, and the like.

(Paper Holder)

The paper 200 is housed in the paper housing 20 in a state where the paper 200 is being kept in the paper holder 70 detachably provided to the casing 10.

Figure 5:
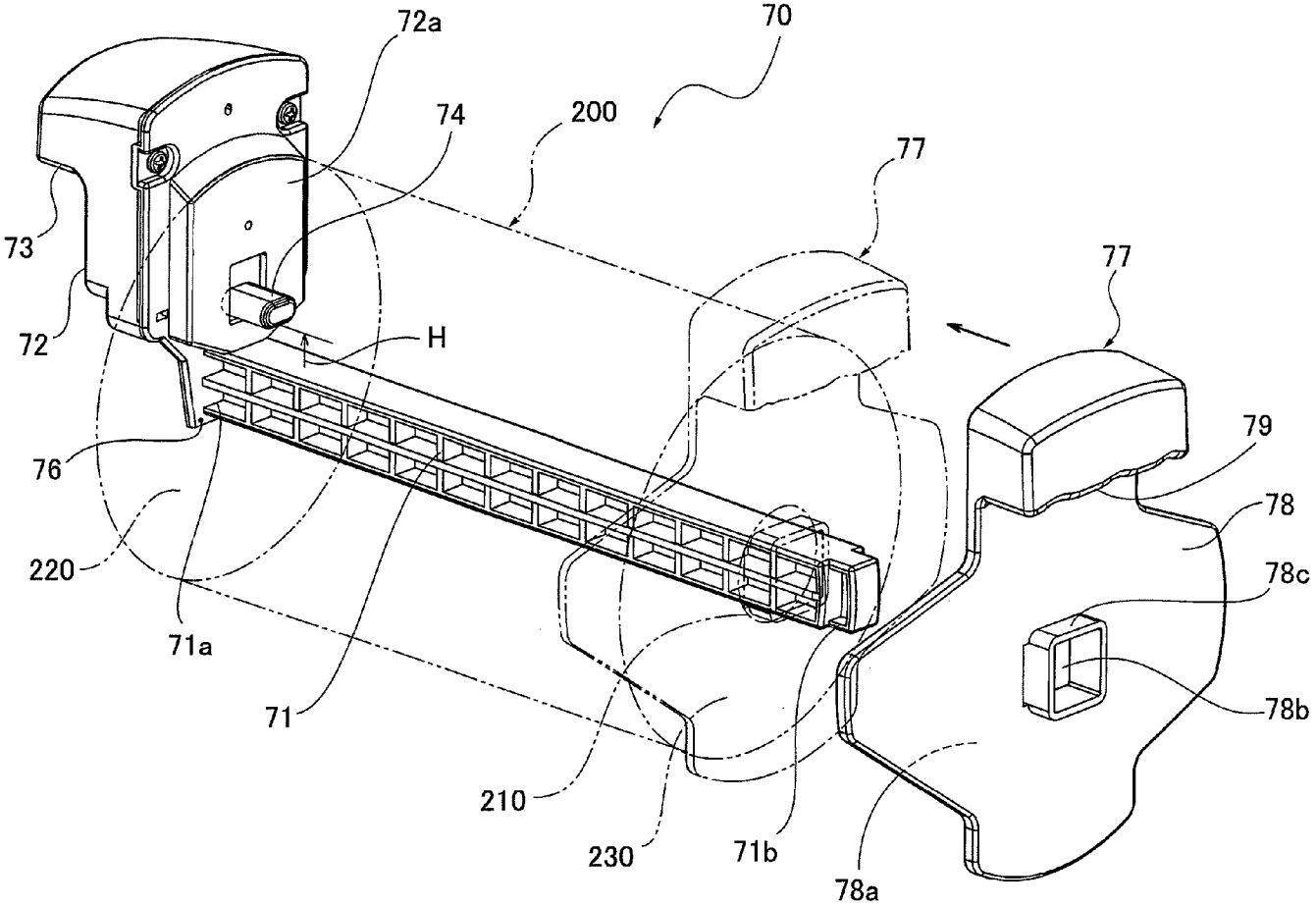
FIG. 5 is a perspective view showing a paper holder.

As shown in FIG. 5, the paper holder 70 includes a bar-like shaft portion 71, a handle 72 provided on a side of a first end portion 71*a* of the shaft portion 71, and a paper width adjusting plate 77 (a paper width adjusting member) detachably provided to the shaft portion 71. The paper 200 is held by the paper holder 70 in such a manner that the paper 200 is rotatably supported in a state where the shaft portion 71 is caused to pass through a through-hole 210 formed in the center portion of the paper 200 (see FIG. 5), and the paper width adjusting plate 77 is attached to the shaft portion 71 from the second end portion 71*b* of the shaft portion 71 to be brought into contact with an end surface 230 of the paper 200 along the axial direction.

Here, in the first end portion 71*a* (one end portion) of the shaft portion 71, a positioning placing unit 76 is formed to attach the paper holder 70 to the positioning receptive portion 23 (FIG. 2) in the paper housing 20 after performing positioning along the axial direction and the positioning along the vertical direction.

Then, the positioning placing unit 76 of the paper holder 70 and the second end portion 71*b* of the shaft portion 71 of the paper holder 70 are respectively attached to the positioning receptive portion 23 of the body 11 and the receptive portion 24 of the body 11, so that the paper holder 70 can be horizontally attached to the body 11 by using the positioning placing unit 76 as a positional reference in the axial direction.

Also, in the first end portion 71*a* of the shaft portion 71, a handle 72 is integrally assembled with the shaft portion 71. The handle 72 vertically extends and has a finger rest portion 73 formed so as to be capable of being lifted with a finger being caught from a lower portion at a tip end portion thereof.

The paper width adjusting plate 77 includes a flat plate-shaped portion 78 and the finger rest portion 79 integrally formed with the plate-shaped portion 78 at an upper end of the plate-shaped portion 78.

The plate-shaped portion 78 has a shaft hole 78*b* formed in the substantially center portion thereof for causing the shaft portion 71 to pass therethrough and has a boss 78*c* formed in a circumferential edge of the shaft hole 78*b*.

In the plate-shaped portion 78, the boss 78*c* is formed on the opposite side to a surface 78*a* (hereinafter referred to as a paper pressing surface 78*a*) on the side supporting the shaft portion 71 and facing the end surface 230 of the paper 200 such that the boss 78*c* rises substantially perpendicularly to the paper pressing surface 78*a*.

Also, an inner periphery surface of the boss 78*c* is formed so as to correspond to an outer contour shape in the cross-section of the shaft portion 71. When the shaft portion 71 is passed through the shaft hole 78*b* from the other end portion 71*b*, the paper pressing surface 78*a* is maintained substantially perpendicular to the axial direction and, at the same time, the plate-shaped portion 78 can be slidably guided along the extending direction of the shaft portion 71.

Accordingly, as shown in FIG. 5, when the shaft portion 71 is passed through the shaft hole 78*b*, the paper pressing surface 78*a* is kept in a state of being substantially perpendicular to the shaft portion 71, and at the same time, the paper width adjusting plate 77 can slide in the axial direction.

As a result, regardless of the paper width of the paper 200 (a length along the width direction W) supported by the shaft portion 71, the entire paper pressing surface 78*a* can be substantially uniformly brought into contact with the end surface 230 of the paper 200 to press the paper 200. Thus, the paper 200 can be prevented from diagonally moving when the paper is fed for printing or the like.

Then, the paper width adjusting plate 77 is caused to slide, together with the paper 200, toward the handle 72 along the axial direction in a state where the paper pressing surface 78*a* is in contact with the end surface 230 of the paper 200, so that the paper 200 can be set near to (against) the side of the handle 72. Thus, the paper 200 can be prevented from randomly moving in the extending direction of the shaft portion 71 to become bumpy. Even when a size of the through-hole 210 of the paper 200 with respect to the shaft portion 71 is sufficient, the paper 200 can be prevented from being inclined relative to the shaft portion 71. Accordingly, the attitude of the paper 200 can be kept stable and horizontal.

Note that a paper facing surface 72*a* of the handle 72 facing the first end surface 220 of the paper 200 which is supported by the shaft portion 71 is formed further outward, in the axial direction, than a wall surface 21*a* (FIGS. 7 and 8) of the wall portion 21 on the side in which the positioning receptive portion 23 of the paper housing 20 is formed in a state where the paper holder 70 is attached to the paper housing 20.

Accordingly, the paper 200 is housed in the paper housing 20 by being supported by the paper holder 70 and is positioned in the axial direction by causing the first end surface 220 on the side of the handle 72 not to be brought into contact with the paper facing surface 72*a* of the paper holder 70 but instead to be brought into contact with the wall surface 21*a* of the body 11.

In this manner, the paper 200 is positioned in the axial direction by using a portion (the wall surface 21*a*) of the body 11 as a reference, so that the precision in positioning the paper 200 with respect to the body 11 can be improved as compared with performing the positioning in the axial direction by using the portion of the paper holder 70 (for example, the paper facing surface 72*a*) as a reference. Thus, the accuracy of detecting the paper 200 by a paper sensor to be described later which is provided in the body 11 can be improved.

When the roll of paper 200 is consumed and needs to be replaced with a new one, the paper width adjusting plate 77 is caused to slide toward the second end portion 71*b* of shaft portion 71 to dismount the paper 200 from the shaft portion 71. Accordingly, the core material of the paper 220 and the like can be dismounted from the end portion 71*b*, and thus the roll of paper 200 can be replaced with a new one.

The finger rest portion 79 formed in the paper width adjusting plate 77 has a function similar to that of the finger rest portion 73 formed in the handle 72. When the shaft portion 71 is passed into the shaft hole 78*b* of the paper width adjusting plate 77, the finger rest portion 73 and the finger rest portion 79 are formed so as to be vertically positioned above the shaft portion 71 at heights substantially the same as each other.

As a result, when both finger rest portions 73 and 79 are lifted by having the fingers caught therein in the state in which the paper 200 is supported in the paper holder 70 and the paper width adjusting plate 77 is attached to the shaft portion 71, if the fingers caught in the both finger rest portions 73 and 79 are lifted in the same heights, the attitude of the paper supported by the paper holder 70 can be horizontally maintained, as similar to the attitude of the fingers.

Accordingly, the operability of detachment and attachment operation of the paper holder 70 with respect to the casing 10 can be improved with the paper 200 being supported in the paper holder 70.

(Movable Member)

A movable member 74 is provided in the handle 72 of the paper holder 70 (near the one end portion 71*a* of the shaft portion 71). The movable member 74 is configured to be displaced along the direction of the shaft portion 71.

This movable member 74 has the bottom surface vertically disposed in a predetermined height position H above the shaft portion 71, and is displaced between a first position (hereinafter, a non-pressing position P1) projecting from the paper facing surface 72*a* facing the one end surface 220 of the paper 200 and a second position (hereinafter, a pressing position P2) being brought into contact with and pressed against the first end surface 220 of the paper 200 supported by the shaft portion 71 and whose major part is pressed into the inside of the handle 72.

Figure 7:
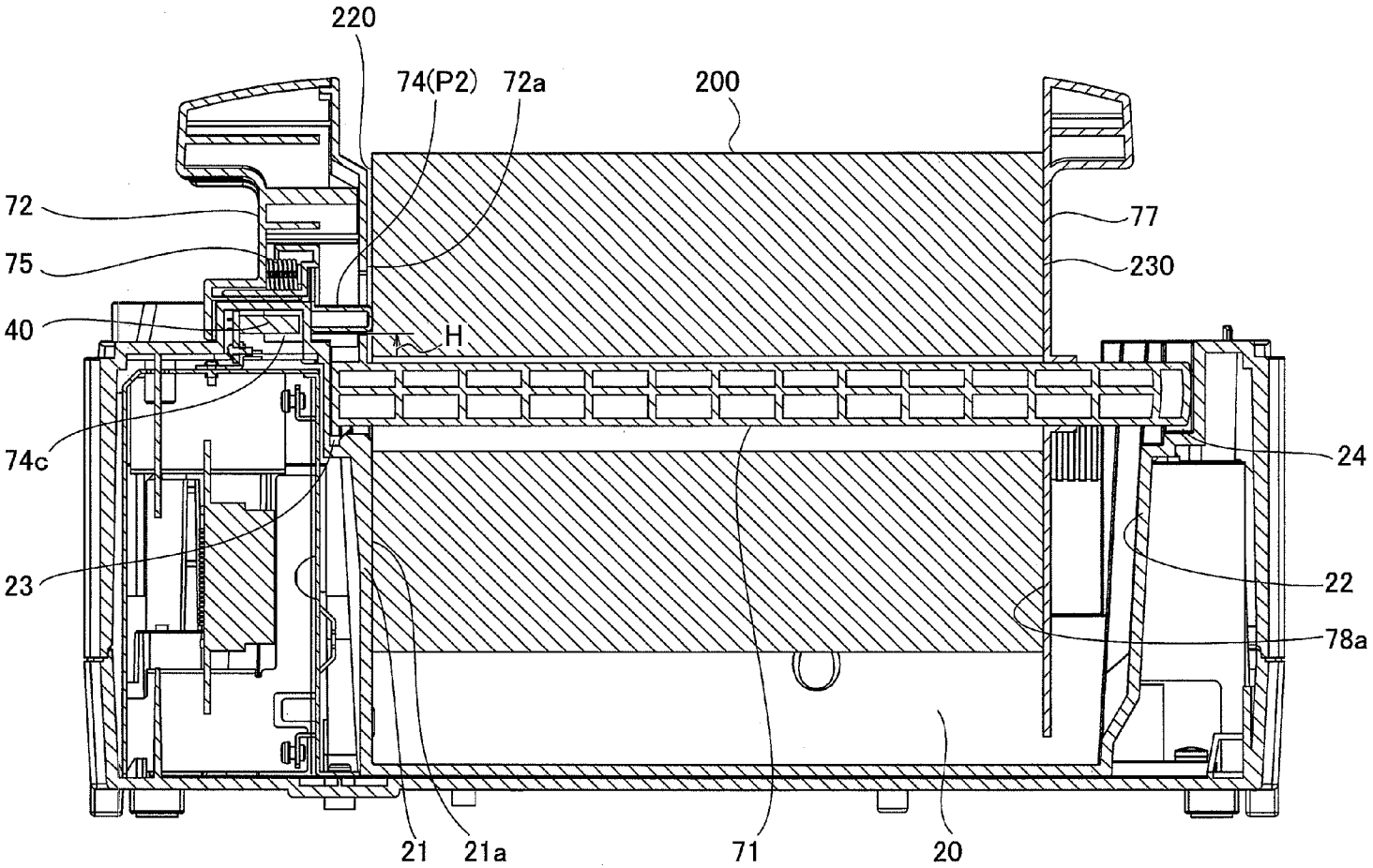
FIG. 7 is a cross-sectional view illustrating a cross-section taken along a shaft portion of the paper holder in a state where a remaining amount of paper is sufficient.

Then, as shown in FIG. 7, the movable member 74 is biased toward the side of the non-pressing position P1 by receiving the elastic force of a coil spring 75 provided inside the handle 72.

Here, the above-described height position H corresponds to the diameter of the remaining amount of the paper 200 supported by the shaft portion 71.

Figure 9B:
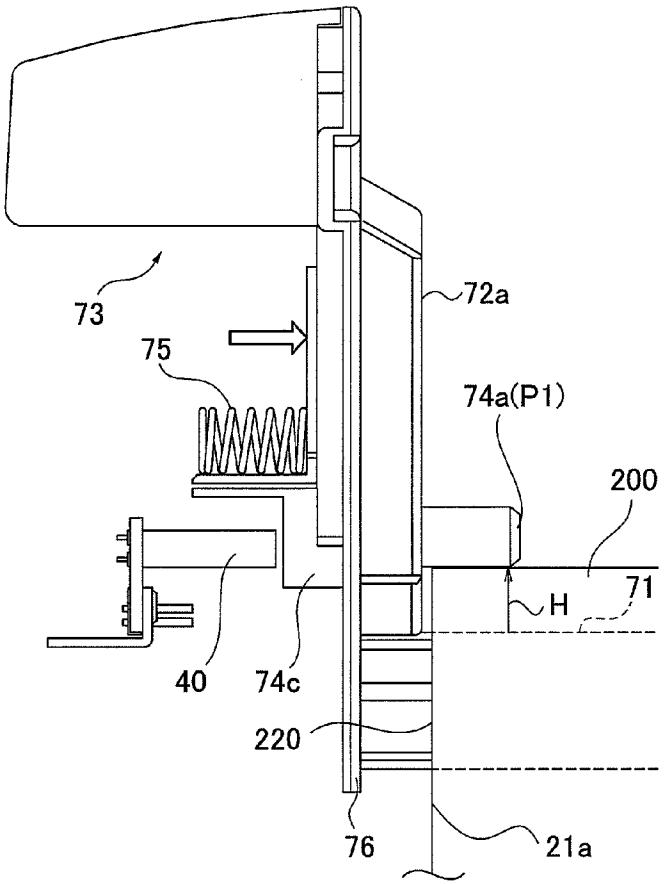
Figure 9A:
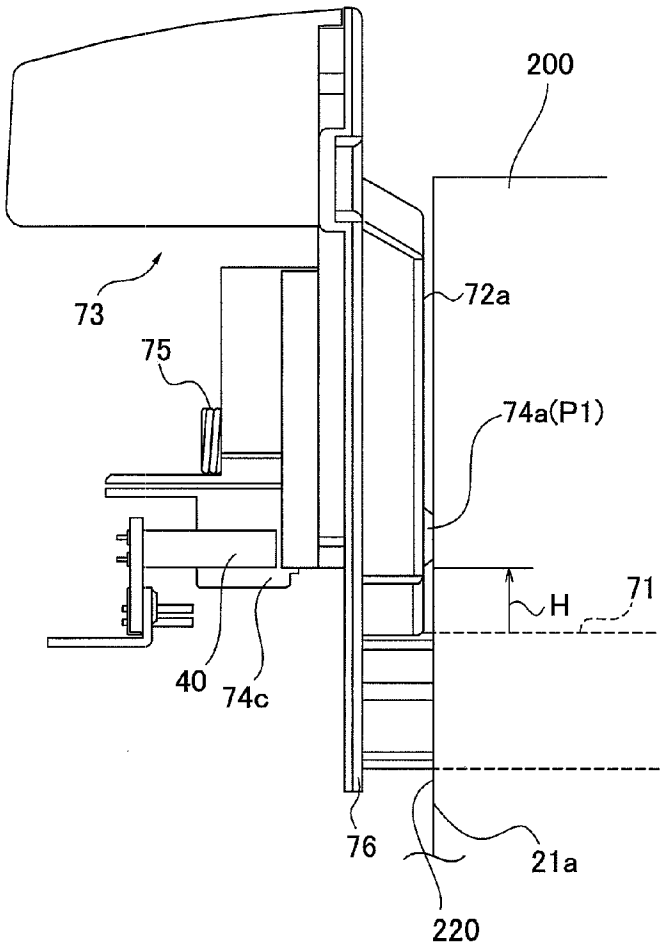

In other words, when the movable member 74 biased to project to the non-pressing position P1 is in the pressing position P2, as shown in FIGS. 7 and 9A, the movable member 74 is pressed by the end surface 220 of the paper 200. Thus, the remaining amount of the paper 200 exceeds the vertical height position H above the shaft portion 71.

Figure 8:
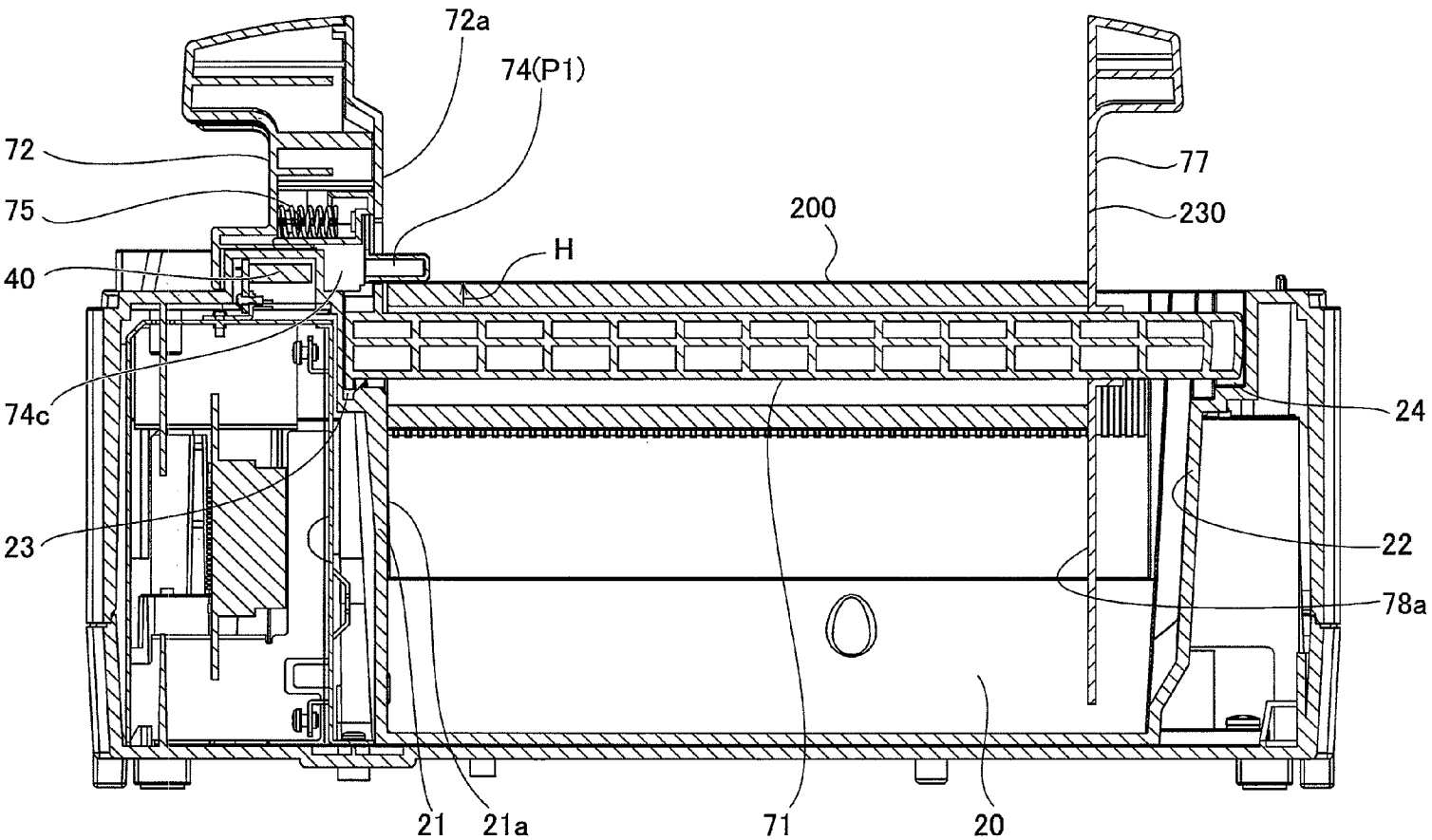
FIG. 8 is a cross-sectional view illustrating a cross-section taken along the shaft portion of the paper holder in a state where the remaining amount of paper is low.

On the other hand, when the movable member 74 is in the non-pressing position P1, the movable member 74 does not receive a force against the elastic force of the coil spring 75. Accordingly, the movable member 74 does not receive pressing force from the end surface 220 of the paper 200. Thus, as shown in FIGS. 8 and 9B, the remaining amount of the paper 200 is lower than the vertical height position H above the shaft portion 71 in the end surface 220.

Figure 6A:
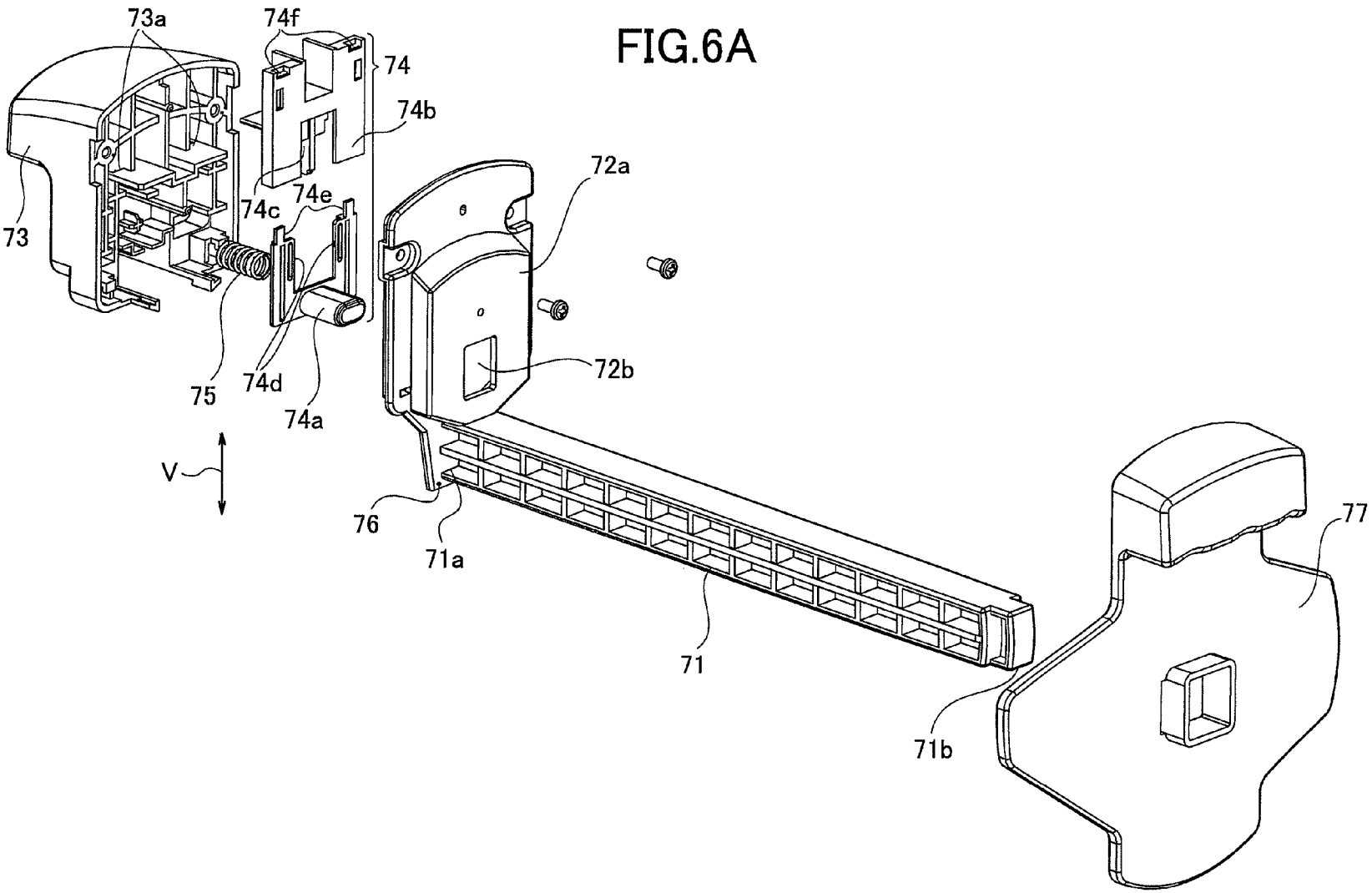
FIG. 6A is an exploded perspective view in which a handle of the paper holder is disassembled.

Specifically, as shown in FIG. 6A, the movable member 74 has a protruding member 74*a* protruding toward the center of the axial direction from the paper facing surface 72*a* of the handle 72, and a sleeve member 74*b* which supports the protruding member 74*a* so as to be slidable within a predetermined range in the vertical direction V and whose movement in the vertical direction V is restricted. In order that the protruding member 74*a* is stopped and kept with a reasonable light locking at proper intervals within the slidable range of the protruding member 74*a*, the sleeve member 74*b* has a rail portion 74*g* (FIG. 6B) in which uneven portions (ridges) are repeatedly formed along the vertical direction, and the protruding member 74*a* has a stop (catch) 74*d* which engages (hangs in) a recessed portion of the rail 74*g* of the uneven portions and warps (resiliently deforms) so as to go over the protruded portion of the rail 74*g* of the uneven portions when the weight (force) along the vertical direction V is received.

Then, the protruding member 74*a* is normally stopped in such a manner that the stop (catch) 74*d* is latched and stopped by any of the recessed portions of the rail 74*g* of the uneven portions of the sleeve member 74*b*. However, when the force along the vertical direction V is received, the stop 74*d* is warped (deformed) by the reaction force from an incline from the recessed portion to the protruded portion and goes over the protruded portion positioned ahead in the force receiving direction and is latched by the recessed portion positioned ahead.

In this manner, the protruding member 74*a* is moved along the vertical direction V and latched in the height position H which is a destination of the movement. Accordingly, the height position H of the movable member 74 relative to the shaft portion 71 can be adjusted.

Thus, the movable member 74 can be displaced along the direction of the shaft portion 71 as a whole (the width direction W of the paper 200). The protruding member 74*a* of the movable member 74 can also moderately slide even in the vertical direction V.

Note that an opening 72*b* is formed in the paper facing surface 72*a* of the handle 72 and allows the protruding member 74*a* to protrude from the inside of the handle 72 toward the end surface 220 of the paper 200. The opening 72*b* is elongated in the vertical direction corresponding to the range in which the protruding member 74*a* is slidable, and is formed so as not to prevent the protruding member 74*a* from sliding along the vertical direction within the slidable range.

Accordingly, the protruding member 74*a* and the sleeve member 74*b* configure a movable member height position adjusting mechanism by which the protruding member 74*a* can be moved in the vertical direction V and a predetermined vertical height position H above the shaft portion 71 is adjusted. If it is desired to have a notification of the remaining amount of the paper 200 in a stage in which the remaining amount is higher, the height position H of the protruding member 74*a* is adjusted to be in a higher position. On the other hand, if it is desired to have a notification of the remaining amount of the paper 200 in a stage in which the remaining amount is low, the height position H of the protruding member 74*a* is adjusted to be in a lower position. In this manner, the remaining amount which is desired to be notified can be adjusted.

Also, a projection 74*e* is formed in the top portion of the protruding member 74*a*. When the protruding member 74*a* is moved in the uppermost position within the slidable range along the vertical direction in a state of being displaced to the pressing position P2, the projection 74*e* protrudes from a hole 74*f* formed in the upper portion of the sleeve member 74*b* to be engaged with a locking portion 73*a* formed inside the finger rest portion 73.

Accordingly, the movable member 74 becomes capable of being held in the pressing position P2. The movable member 74 is fixed in the pressing position P2 by the mechanism (the movable member holding mechanism) to hold the movable member 74 in the pressing position P2, so as to be capable of handling a case, to be described later, in which the notification of the remaining amount of the paper 200 is not required.

Figure 6B:
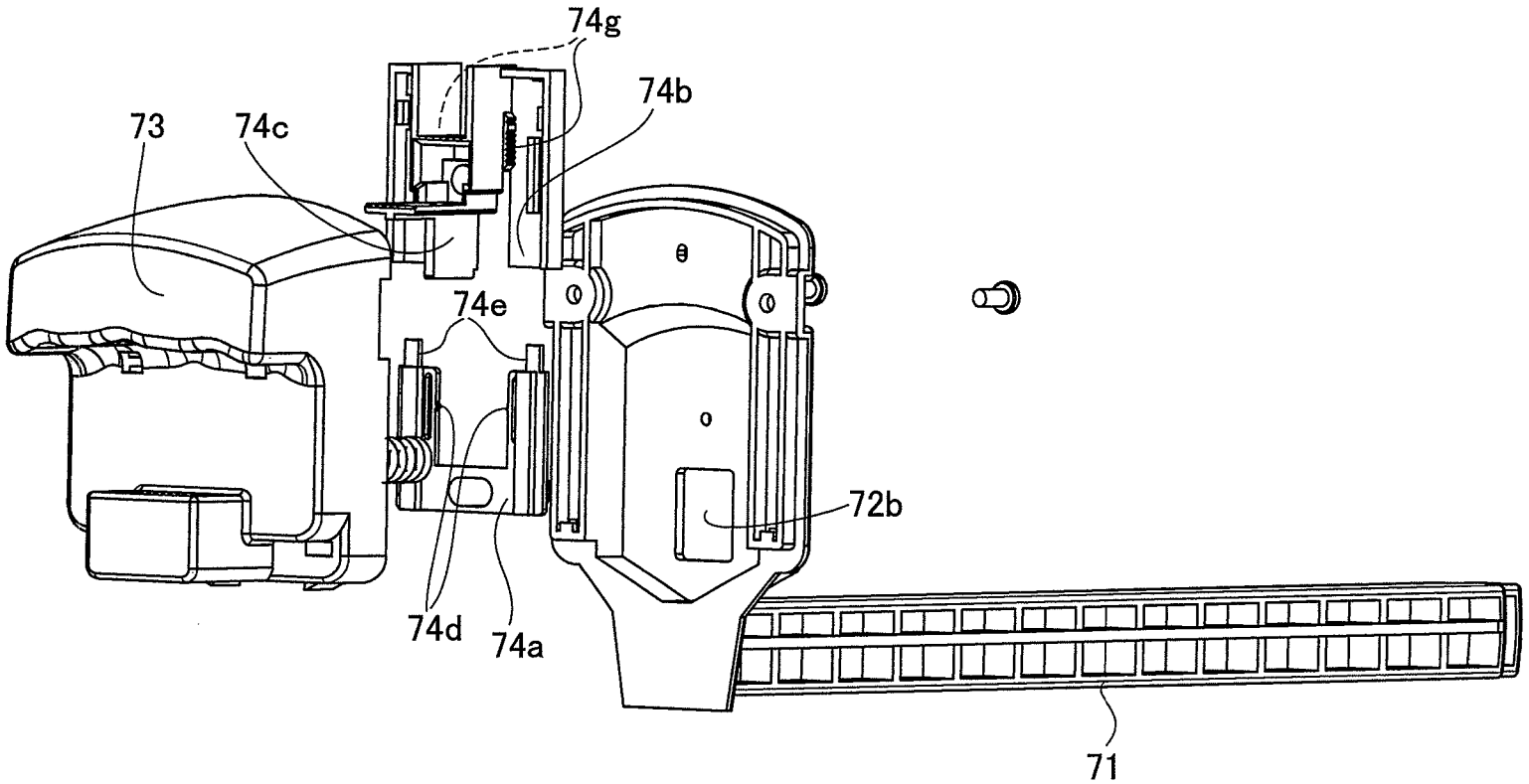
FIG. 6B is a drawing in which the paper holder shown in FIG. 6A is seen from a side of a finger rest.

Also, as shown in FIGS. 6A and 6B, a light-shielding plate 74*c* extending along the direction of the shaft portion 71 is formed in the sleeve member 74*b*. The light-shielding plate 74*c* is displaced between the pressing position P2 and the non-pressing position P1 of the movable member 74 and is also displaced along the shaft portion 71.

(Photosensor)

A photosensor 40 (movable member detector) is provided in a portion near the paper housing 20 of the body 11 (a portion of the body 11).

Figure 10:
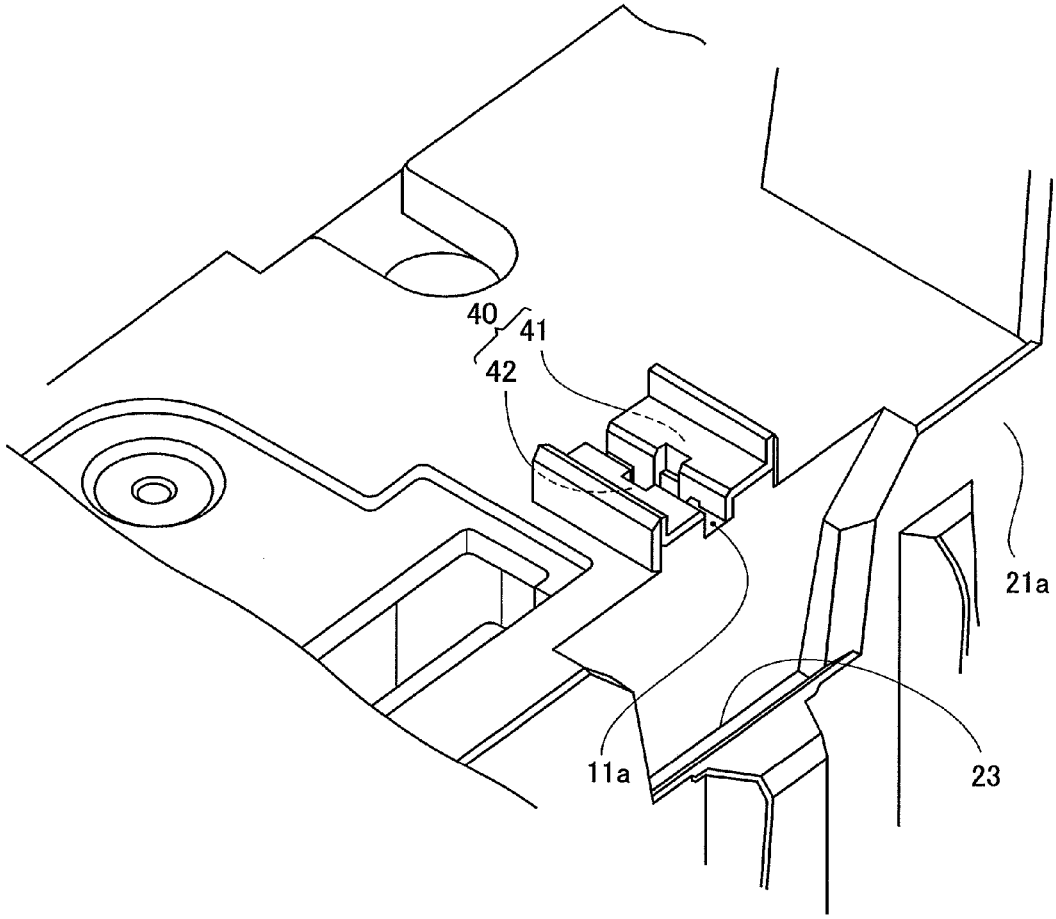
FIG. 10 is a perspective view of an essential part illustrating a position of the photosensor to detect a non-pressing position where the movable member is not pressed.

As shown in FIG. 10, this photosensor 40 includes a light source 41 disposed across a groove 11*a* which is formed in the body 11 and extends in the axial direction and a light detector 42 to detect light emitted from the light source 41 through the groove 11*a*. The positioning placing unit 76 of the paper holder 70 is positioned in the positioning receptive portion 23 of the body 11, and the second end portion 71*b* of the shaft portion 71 of the paper holder 70 is positioned in the receptive portion 24 of the body 11. Then, the photosensor is designed so that when the movable member 74 is in the pressing position P2 with the paper holder 70 being housed in the paper housing 20, a light path passing from the light source 41 to the light detector 42 is blocked by the light-shielding plate 74*c* of the movable member 74 which is passed through the groove 11*a* (see FIG. 9A).

This photosensor 40 is a transmission type photosensor (a photo-interrupter). As shown in FIG. 9A, when the movable member 74 is in the pressing position P2, the photosensor 40 is in a state where light cannot be detected because the light is blocked by the light-shielding plate 74*c* (an off state). On the other hand, as shown in FIG. 9B, when the movable member 74 is in the non-pressing position P1, the photosensor 40 is in an on state in which the light is detected (see FIG. 9B). As can be seen from a comparison of FIGS. 9A and 9B, the movable member 74 is configured with respect to the positioning placing unit 76, the coil spring 75, the paper facing surface 72*a*, and the finger rest portion 73 such that the protruding member 74*a* of the movable member 74 moves linearly parallel to the shaft portion 71.

Accordingly, the photosensor 40 can detect that the movable member 74 is in the non-pressing position P1 in distinction from that the movable member 74 is in the pressing position P2.

As described above, when the movable member 74 is in the non-pressing position P1, it is in the state in which the remaining amount of paper is low, that is, the height (radius) of the end surface 220 of the roll of paper 200 is lower than the height position H. Thus, the photosensor 40 detects that the movable member 74 is in the non-pressing position P1, so that it can be detected that the remaining amount of the paper 200 is low.

(Remaining Amount Notifying Unit)

A remaining amount notifying unit 90 (remaining amount notifier) is provided for notifying that the reaming amount of the paper 200 is low according to a detected result of the photosensor 40.

This remaining amount notifying unit 90 is to notify that the remaining amount of paper 200 is low when the photosensor 40 detects that the movable member 74 is in the non-pressing position P1. In the printer 100 according to the present embodiment, the remaining amount notifying unit 90 is provided as one notification light in the operation unit 60 provided on the front surface of the casing 10.

However, the remaining amount notifying unit 90 may output the notification as other visual displays, or may be a remaining amount notifying buzzer to output sound, or may perform printing of the remaining amount notification on the paper 200 by controlling the printing unit.

As described above, in the printer 100 according to the present embodiment, when the paper holder 70 is positioned and placed in the body 11, the photosensor 40 provided in the body 11 can detect the displacement of the movable member 74 provided in the paper holder 70 to the non-pressing position P1. When the remaining amount of the paper 200 is sufficient (in the case of the amount exceeding the vertical height position H above the shaft portion 71), the movable member 74 is in the pressing position P2. Accordingly, the photosensor 40 does not detect the non-pressing position P1 of the movable member 74. However, when the remaining amount of the paper 200 becomes low to be below the vertical height position H above the shaft portion 71, the movable member 74 is displaced to the non-pressing position and thus the photosensor 40 detects the non-pressing position P1 of the movable member 74. Then, the remaining amount notifying unit 90 having received the detection result can output the notification that the remaining amount of the paper 200 is low (paper-near-end).

Here, the result detected by the photosensor 40 is supplied to the remaining amount notifying unit 90 to be a trigger to output the remaining amount notification. Accordingly, the result detected by the photosensor 40 is converted to an electric signal or optical signal inside the photosensor 40. The electric signal or the optical signal is supplied to the remaining amount notifying unit 90 through an electric wiring or an optical fiber.

In other words, the photosensor 40 has to be connected with the electric wiring or the optical fiber, but the place where the electric wiring or the optical fiber is disposed is inside the body 11, and the paper holder 70 which is attached or detached with respect to the body 11 does not require to include the electric wiring or the optical fiber. Thus, when the paper holder 70 is attached or detached with respect to the body 11 for replacing the paper 200 or the like, special attention to the wired state of the electric wiring or the optical fiber is not required. Also, the spacing between the paper holder 70 and the body 11 or the attitude of the paper holder 70 is not restricted by the wired state in a detached state. Accordingly, convenience in the practical aspect can be improved.

On the other hand, the body 11 does not need to include the mechanically moving complex movable member 74. Thus, the structure of the body 11 can be simplified.

Also, according to the printer 100 according to the present embodiment, the movable member 74 which is configured to be displaced by being pressed by the end surface 220 of the paper 200 is provided in the predetermined vertical height position H above the shaft portion 71. Accordingly, regardless of the diameter of the through-hole in the center portion of the paper 200, and even when the paper 200 is shaken with respect to the shaft portion 71, the influence is hardly received. Thus, the remaining amount of the paper 200 corresponding to the predetermined height position H from the upper edge portion of the through-hole supported by the shaft portion 71 can be stably detected.

Furthermore, the movable member 74 is displaced along the axial direction. However, when the paper 200 is set in the paper holder 70, the paper 200 is caused to slide in the axial direction by causing the shaft portion 71 to pass through the through-hole of the paper 200, and the displacement direction of the movable member 74 meets with the direction in which the paper 200 is set in the paper holder 70. The movable member 74 can be displaced without imposing the weight in a direction other than the moving direction thereof. Thus, improved durability of the movable member 74 or an excessively strong movable member 74 are not required. Accordingly, the manufacturing cost can be reduced.

Furthermore, with an operation of setting new paper 200 (whose remaining amount is sufficient) in the paper holder 70, the paper 200 set by sliding to the first end portion 71*a* of the shaft portion 71 automatically causes the movable member 74 provided near the first end portion 71*a* of the shaft portion 71 to be displaced to the pressing position P2. Thus, the user does not waste his/her extra time.

Note that the printer 100 according to the embodiment adopts the photosensor 40 as the movable member detector for detecting that the movable member 74 is in the non-pressing position P1 in distinction from that the movable member 74 is in the pressing position P2. However, in place of the photosensor 40, a reflective type photosensor (a photo reflector) can be adopted. Also, in place of the optical detector like these photosensors, ones to electrically or magnetically perform detection can be adopted.

(Paper Detector)

The paper 200 to be used for the printer 100 according to the present embodiment is formed in such a manner that paste-on labels are affixed to a long paper liner with adequate intervals. In this printer 100, a built-in controller 52 in the body 11 controls a driving mechanism such as a platen roller 51 for paper conveyance, a printing unit 30, or the like so as to perform printing in label portions.

In this case, the range of the paper 200 to which the labels are affixed is required to be accurately detected. For this reason, the printer 100 is provided with a paper detecting unit 80 to detect a label on a conveyance route R of the paper 200 before the printing unit 30 (an upper stream side in the conveyance direction of the paper 200).

The paper detecting unit 80 is configured of a transmission type photosensor (a photo-interrupter) as similar to a movable member detector, for example.

The paper 200 has many labels affixed at predetermined intervals on the long paper liner. The transmission-type photosensor detects a portion where the labels are affixed in distinction from a portion where the labels are not affixed (there is only a paper liner) by detecting a difference between a light transmitting rate of the portion where there is only the paper liner and a light transmitting rate of the portion where the labels are affixed on the paper liner of the paper 200.

Figure 11:
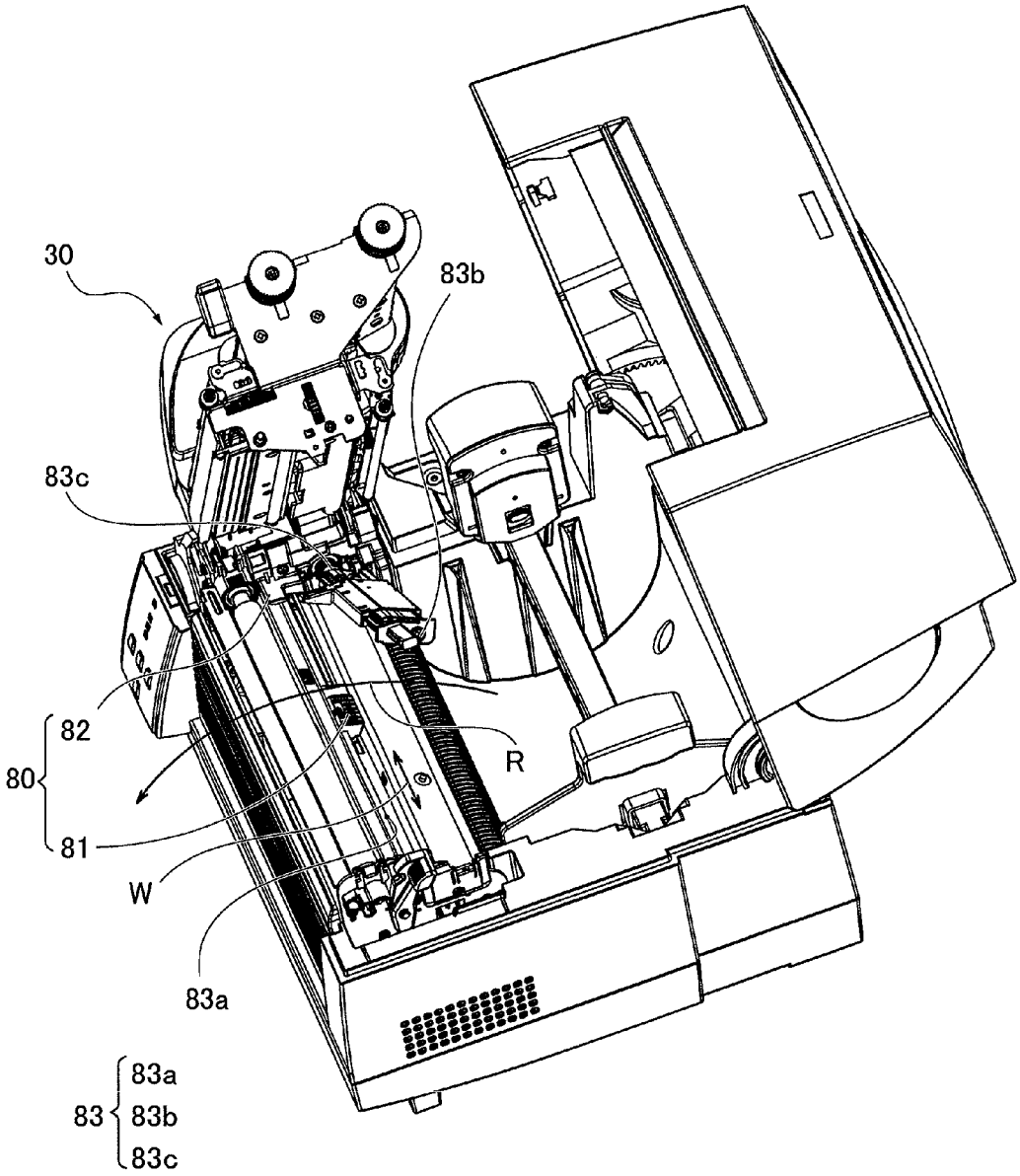
FIG. 11 is a perspective view illustrating a state where a paper detecting unit to detect a label is attached.

Accordingly, as shown in FIG. 11, by providing the paper detecting unit 80 which is configured in such a manner that a light source 81 is disposed on one surface side of the paper 200 (for example, the lower surface side of the paper 200) so as to vertically sandwich the conveyance route R on the conveyance route R before the printing unit 30 and a light detector 82 is disposed on the other surface side (for example, the upper surface side of the paper 200), when an amount of light detected by the light detector 82 is decreased, it can be detected that the portion where the labels are adhered has passed.

For this reason, by using the position in which the pass of the portion where the labels are affixed is detected as a reference, the range in which the labels are affixed can be detected to accurately perform printing on the labels by the printing unit 30.

Here, the printer 100 according to the embodiment can use multiple kinds of paper 200 with different paper widths. Thus, there is a case where paper 200 with a narrow paper width is used or a case where paper 200 with a wide paper width is used.

In addition, the above described labels may have different adhesion ranges in the width direction according to the width difference of the paper housed in the paper housing 20.

The paper detecting unit 80 cannot properly detect the portion where the labels are affixed if the paper is not placed so as to meet the label adhesion range in the width direction W.

On the conveyance route R of the paper, as shown in FIG. 11, the printer 100 according to the embodiment has the light source 81 which is disposed on the lower surface side of the paper 200 and is provided so as to be movable in the width direction W and the light detector 82 which is disposed on the upper surface side of the paper 200 and is also provided so as to be movable in the width direction W. Furthermore, the printer 100 is provided with a cooperative mechanism 83 which is moved along the width direction W by causing the position of the light source 81 and the light detector 82 to work with each other while matching the position of the light source 81 along the width direction W with the position of the light detector 82.

Specifically, this cooperative mechanism 83 is disposed on the upper surface side of the paper 200 to be conveyed on the conveyance route R and is configure of a spiral shaft 83*a*, a spiral shaft 83*b*, and a gear train 83*c*.

Then, when one portion of the gear train 83*c* is rotated with a finger or the like, the gear train 83*c* rotates. In conjunction with the rotation of the gear train 83*c*, the spiral shafts 83*a* and 83*b* are driven by the rotation. Then, the light source 81 provided in the spiral shaft 83*a* and the light detector 82 provided in the spiral shaft 83*b* are synchronized with each other to keep the positions in the width direction W matched with each other and then are moved along the width direction.

The printer 100 according to the embodiment, which is configured as described above, can cause the light source 81 and the light detector 82 to work together by one operation (the operation of rotating the one portion of the gear train 83*c* with a finger or the like). Thus, the user is not required to separately perform the operation of moving the light source 81 and the operation of moving the light detector 82.

Furthermore, if the operation of moving the light source 81 and the operation of moving the light detector 82 are separately performed, the light source 81 and the light detector 82 have to be also aligned with each other. The printer of the embodiment can also eliminate such a labor, and can improve the usability.

Note that FIG. 11 illustrates a state in which the spiral shaft 83*b* which is disposed on the upper surface side of the paper 200 and has the light detector 82 being provided therein is lifted and also illustrates a state in which the paper is placed along the conveyance route R.

Here, the gear train 83*c* is configured of a gear train using a bevel gear, so that the light source 81 and the light detector 82 can be moved together even in the lift-up state.

Figure 12:
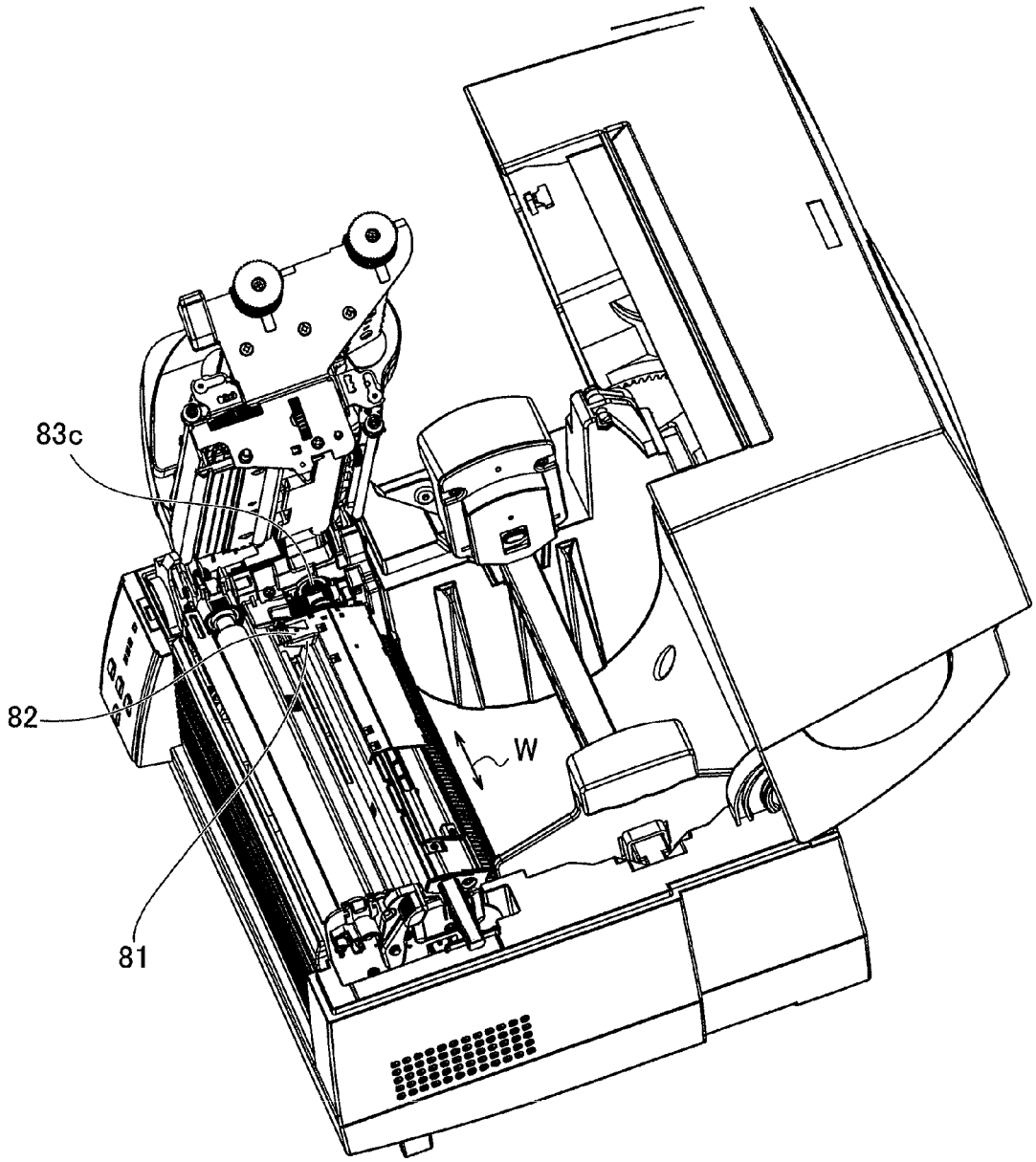
FIG. 12 is a drawing (No. 1) illustrating a state where the paper detecting unit is moved in the paper width direction.
Figure 13:
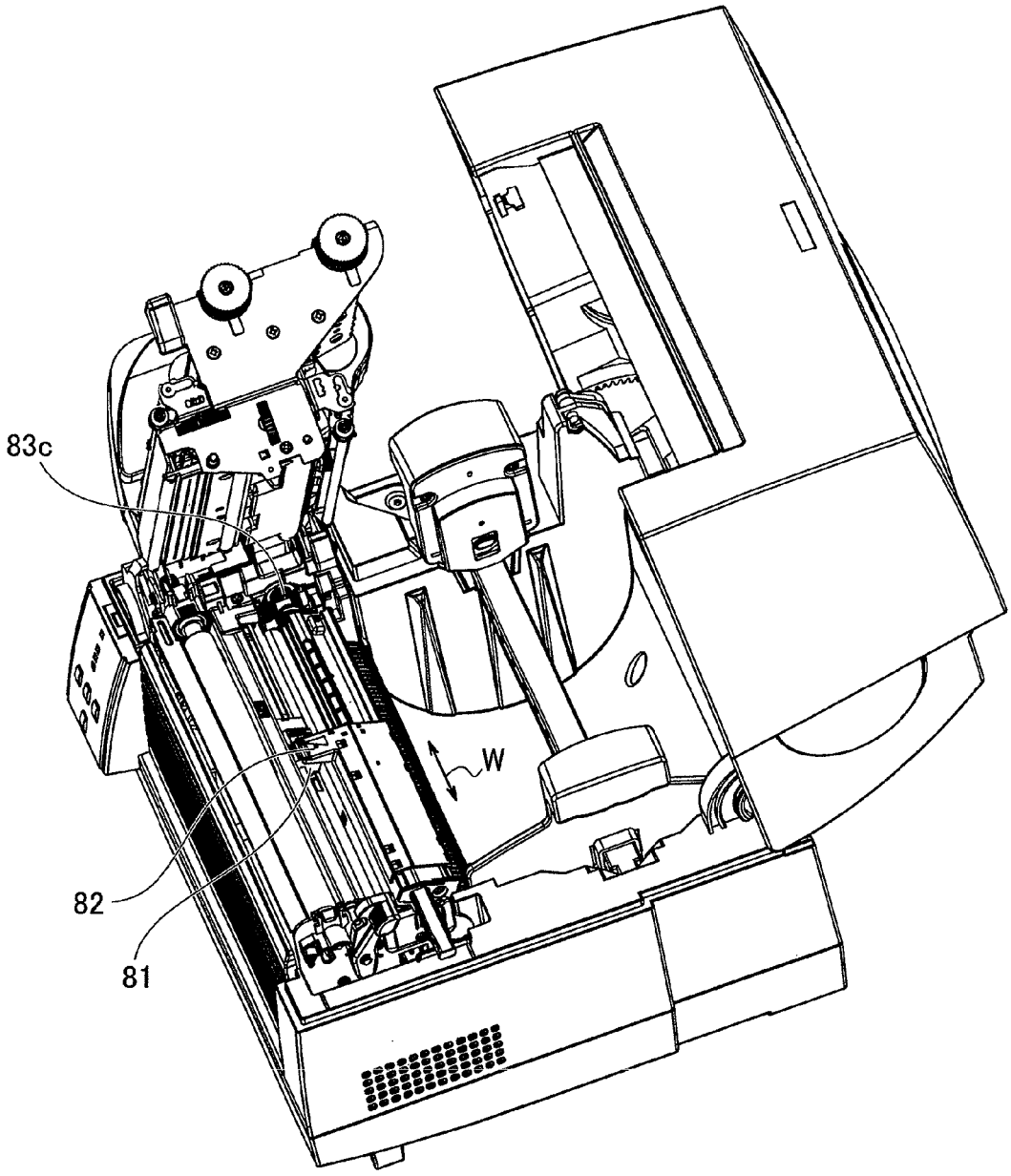
FIG. 13 is a drawing (No. 2) illustrating a state where the paper detecting portion is moved in the paper width direction.

FIGS. 12 and 13 illustrate a state in which the spiral shaft 83*b* is returned to a state of being used and illustrates a state where the light source 81 and the light detector 82 are synchronized to meet the positions in the width direction W when the one portion of the gear train 83*c* is rotated with a finger or the like.

(Printing Unit)

Figure 14:
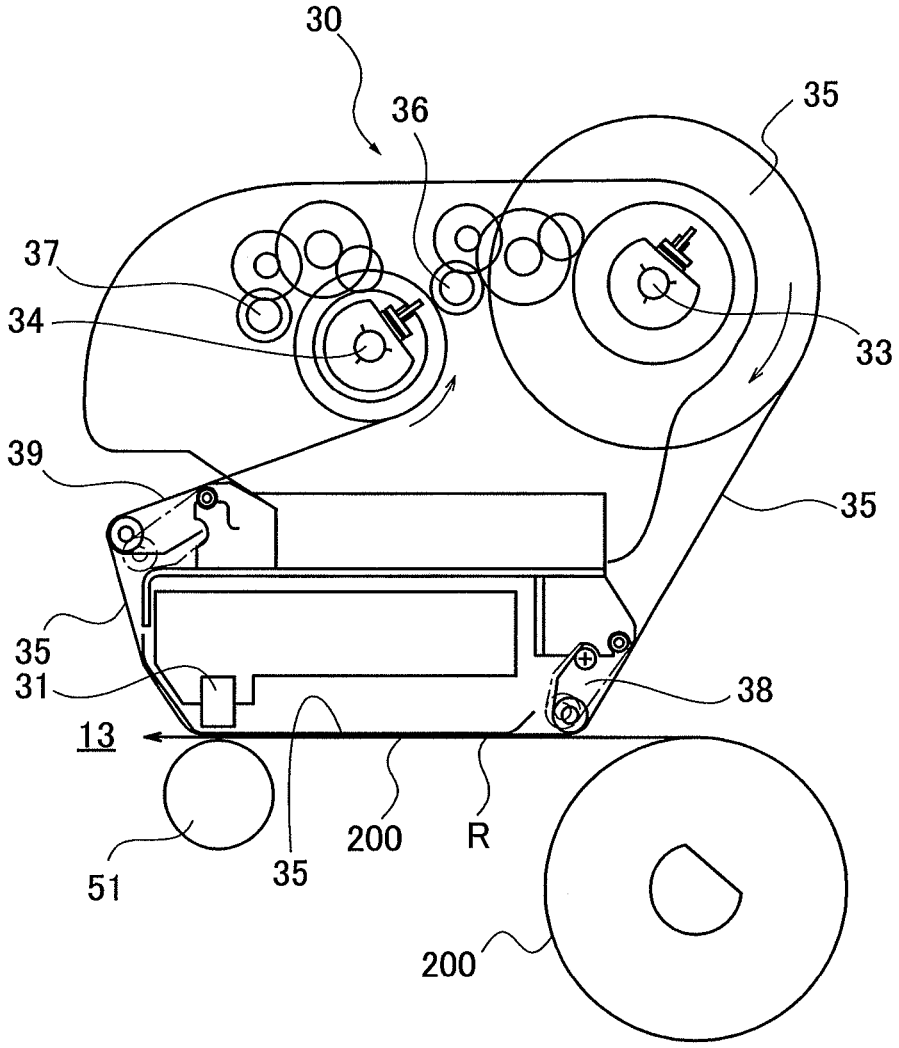
FIG. 14 is a schematic view illustrating a printing unit.

As shown in FIG. 14, the printing unit 30 includes a printing head 31 disposed above the platen roller 51 in a state of facing to the platen roller 51 disposed in the body 11 as well as an ink ribbon 35 which is fed together with the paper 200.

The ink ribbon 35 before being used is rolled as similar to the paper 200 so as to be rotatable around a feeding side supporting shaft 33, and a feeding side motor 36 linked with the feeding side supporting shaft 33 through the gear train is driven by the rotation, so that the feeding side supporting shaft 33 rotates and the ink ribbon 35 is fed from the feeding side supporting shaft 33.

On the other hand, the ink ribbon 35 which is fed is superimposed on the paper 200 to be conveyed on the conveyance route R, which is used when it passes through the printing position between the printing head 31 and the platen roller 51.

Then, a take-up side supporting shaft 34 linked with a take-up side motor 37 through the gear train is provided on the downstream side in the conveyance direction of the used ink ribbon 35 after being used in the printing position. The take-up side motor 37 is driven by the rotation, so that the take-up side supporting shaft 34 rotates and the ink ribbon 35 after used in the printing head 31 is taken up by the take-up side supporting shaft 34.

Here, when they are assumed that a path of the ink ribbon 35 from the feeding side supporting shaft 33 to the printing position is referred to as a feeding side path and a path of the ink ribbon 35 from the printing position to the take-up side supporting shaft 34 is referred to as a take-up side path, a first ribbon tension detector 38 to detect tension of the ink ribbon 35 on the feeding side path in four levels is provided on the feeding side path and a second ribbon tension detector 39 to detect tension of the ink ribbon 35 in the take-up side path in four levels is provided on the take-up side path.

Also, the body 11 includes a controller 52 which controls the feeding side motor 36 so as to change the number of driving rotations of the feeding side motor 36 according to the tension level of the ink ribbon 35 on the feeding side path, which is detected by the first ribbon tension detector 38 and controls a take-up side motor 37 so as to change the number of driving rotations of the take-up side motor 37 according to the tension level of the ink ribbon 35 on the take-up side path, which is detected by the second ribbon tension detector 39.

Note that the controller 52 performs feeding control of rotating or stopping the platen roller 51, or printing control of the printing head 31. However, the specific contents of the control are already known, and the description thereof is omitted.

The number of rotations of the feeding side motor 36 is specifically controlled by the controller 52 as follows:

(1) when the tension level of the ink ribbon 35 on the feeding side path, which is detected by the first ribbon tension detector 38, is in the highest level, the feeding side motor 36 is controlled so as to rotate at the fastest rotation number, (2) when the tension level of the ink ribbon 35 on the feeding side path, which is detected by the first ribbon tension detector 38, is in the second highest level, the feeding side motor 36 is controlled so as to rotate at the second fastest rotation number, (3) when the tension level of the ink ribbon 35 on the feeding side path, which is detected by the first ribbon tension detector 38, is in the third highest level, the feeding side motor 36 is controlled so as to rotate at the third fastest rotation number, and (4) when the tension level of the ink ribbon 35 on the feeding side path, which is detected by the first ribbon tension detector 38, is in the lowest level, the feeding side motor 36 is controlled so as to rotate at the slowest rotation number (or stop the rotation).

In this manner, the feeding side motor 36 is controlled according to the tension level of the ink ribbon 35 on the feeding side path, so that the tension of the ink ribbon 35 on the feeding side path can be adjusted in a proper range.

Furthermore, the number of rotations of the feeding side motor 36 can be adjusted in the four levels, so that the tension of the ink ribbon 35 on the feeding side path can be adjusted carefully by adjusting the number of rotations of the feeding side motor 36 in consideration of the diameter (the remaining amount) of the ink ribbon 35 which is wrapped around the feeding side supporting shaft 33.

The number of rotations of the take-up side motor 37 is specifically controlled by the controller 52 as follows:

(5) when the tension level of the ink ribbon 35 on the take-up side path, which is detected by the second ribbon tension detector 39, is in the highest level, the take-up side motor 37 is controlled so as to rotate at the slowest rotation number (or stop the rotation), (6) when the tension level of the ink ribbon 35 on the take-up side path, which is detected by the second ribbon tension detector 39, is in the second highest level, the take-up side motor 37 is controlled so as to rotate at the second slowest rotation number, (7) when the tension level of the ink ribbon 35 on the take-up side path, which is detected by the second ribbon tension detector 39, is in the third highest level, the take-up side motor 37 is controlled so as to rotate at the third lowest rotation number, and (8) when the tension level of the ink ribbon 35 on the take-up side path, which is detected by the second ribbon tension detector 39, is in the lowest level, the take-up side motor 37 is controlled so as to rotate at the fastest rotation number.

In this manner, the take-up side motor 37 is controlled according to the tension level of the ink ribbon 35 on the take-up side path, so that the tension of the ink ribbon 35 on the take-up side path can be adjusted in a proper range.

Furthermore, the number of rotations of the take-up side motor 37 can be adjusted in the four levels, so that the tension of the ink ribbon 35 on the take-up side path can be adjusted carefully by adjusting the number of rotations of the take-up side motor 37 in consideration of the diameter of the ink ribbon 35 which is wrapped around the take-up side supporting shaft 34.

(Ribbon Tension Detector)

Note that the first ribbon tension detector 38 and the second ribbon tension detector 39 are to detect the tension of the ink ribbon 35 in the four levels. Hereinafter, the configuration corresponding to the functions to detect the tension in the four levels are described.

In the following description, the second ribbon tension detector 39 is described in detail, but the first ribbon tension detector 38 and the second ribbon tension detector 39 basically have the same configuration. Accordingly, the description of the second ribbon tension detector 39 can be invoked in that of the first ribbon tension detector 30 whose description is omitted.

Figure 15:
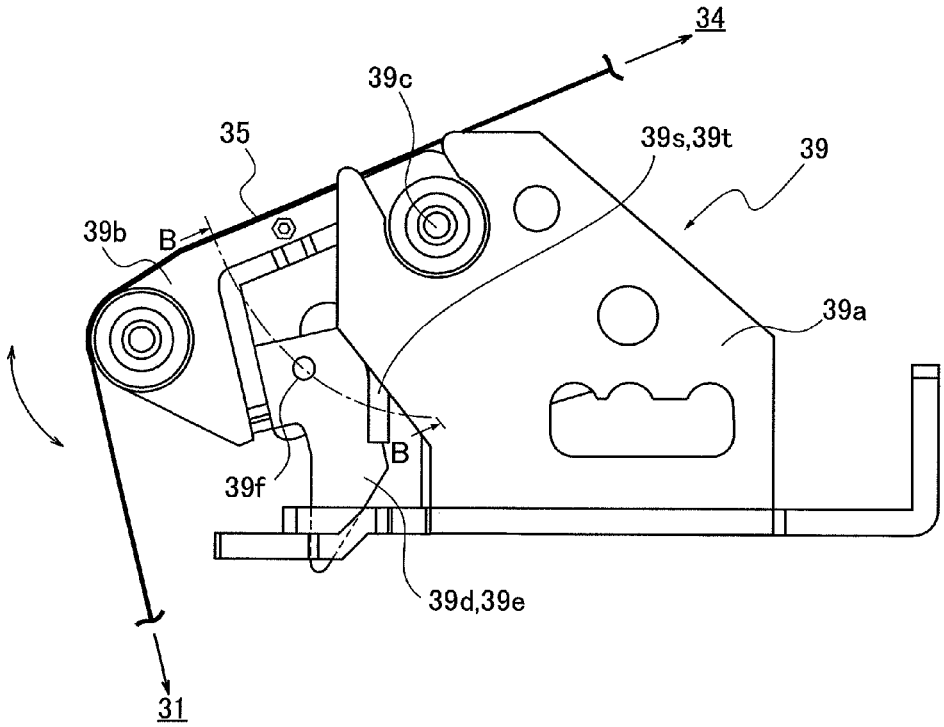
FIG. 15 is a schematic view illustrating a second ribbon tension detector.

As shown in FIG. 15, the second ribbon tension detector 39 includes a base member 39*a* which is fixed in a framework member of the printing unit 30, a tension detecting lever 39*b* whose one portion of the outer circumference is wrapped by the ink ribbon 35 and which is supported by the base member 39*a* to be swingable around a rotation shaft 39*c* near one end portion with respect to the base member 39*a*, two light-shielding plates 39*d* and 39*e* which are formed in one portion of the tension detecting lever 39*b*, a photosensor (a photo-interrupter) 39*s* which detects the light-shielding in distinction from the light transmission, which are performed by the light-shielding plate 39*d*, and is fixed in the base member 39*a* and a photosensor (a photo-interrupter) 39*t* which detects the light-shielding in distinction from the light transmission, which are performed by the light-shielding plate 39*e*, and is fixed in the base member 39*a*.

Here, in FIG. 15, the light-shielding plate 39*e* is on the rear surface side of the light-shielding plate 39*d* (the back side in the paper depth direction) and is entirely hidden by the light-shielding plate 39*d*. The photosensor 39*t* is also on the rear surface side of the photosensor 39*s* and is entirely hidden by the photosensor 39*s*.

A coil spring is provided between the tension detecting lever 39*b* and the base member 39*a*. The tension detecting lever 39*b* is biased in the clockwise direction around the rotation shaft 39*c* by the elastic force of the coil spring.

Figure 16:
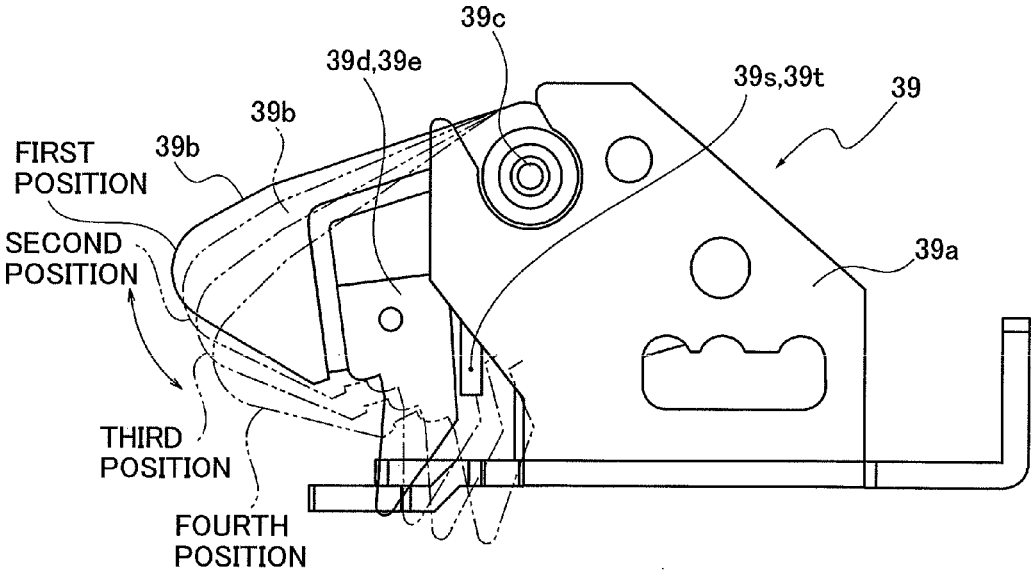
FIG. 16 is a schematic view illustrating positions (a first position, a second position, a third position, and a fourth position) of a tension detection lever of the second ribbon tension detector.

Then, as the tension of the ink ribbon 35 which is wrapped around the outer circumference of the tension detecting lever 39*b* becomes higher, as shown in FIG. 16, the tension detecting lever 39*b* rotates counterclockwise around the rotation shaft 39*c* from the first position, second position, third position, and fourth position by resisting the elastic force of the coil spring.

Here, of the two light-shielding plates 39*d* and 39*e*, the light-shielding plate 39*d* which is disposed at the front side in the paper depth direction of FIG. 16 has a tip end, which is formed so as to be longer than that of the light-shielding plate 39*e* disposed on the back side in the paper depth direction, in the counterclockwise direction around the rotation shaft 39*c* as shown in FIGS. 17A to 17D and has a through-hole 39*f* in a portion where is one portion of the range passing through the photosensor 39*s* and corresponds to the front surface of the photosensor 39*s* when the tension detecting lever 39*b* shown in FIG. 16.

The tension detecting lever 39*b* rotates counterclockwise around the rotation shaft 39*c* according to the tension of the ink ribbon 35 on the take-up side path. The positional relationships between the photosensors 39*s* and 39*t* and the light-shielding plates 39*d* and 39*e* in the first position which is the position where the tension of the ink ribbon 35 is small and in the second position, third position, and fourth position which are the positions where the tension gradually becomes larger, are as shown in FIGS. 17A to 17D. The output signals of the photosensors 39*s* and 39*t* are (A), (B), (C), and (D) as follows.

Figure 17A:
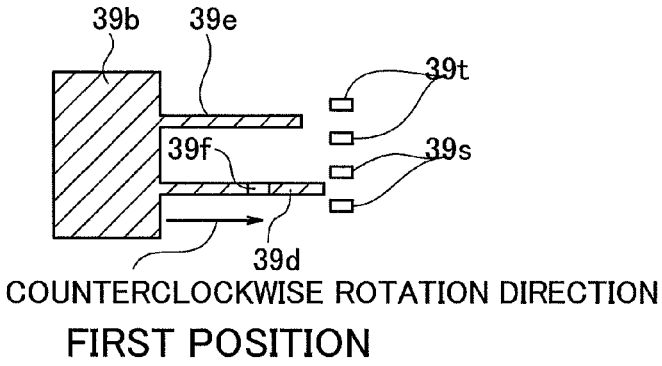
FIGS. 17A to 17D are cross-sectional view respectively illustrating a positional relationship between each photosensor and each light-shielding plate in the positions (the first, second, third, and fourth positions) shown in FIG. 16 and a cross-section taken along the B-B line in FIG. 15.

(A) In the first position in which the tension of the ink ribbon 35 is in the smallest level, as shown in FIG. 17A, the photosensor 39*s* outputs an on signal because light is not blocked by the light-shielding plate 39*d* and the photosensor 39*t* also outputs an on signal because light is not blocked by the light-shielding plate 39*e*.

Figure 17B:
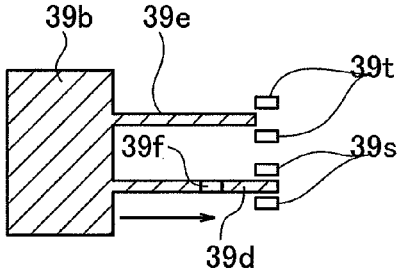

(B) In the second position in which the tension of the ink ribbon 35 is in the second smallest level, as shown in FIG. 17B, the photosensor 39*s* outputs an off signal because light is blocked by the light-shielding plate 39*d* and the photosensor 39*t* outputs an on signal because light is not blocked by the light-shielding plate 39*e*.

Figure 17C:
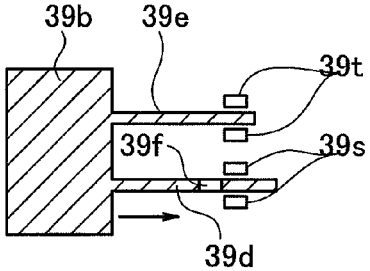

(C) In the third position in which the tension of the ink ribbon 35 is in the third smallest level, as shown in FIG. 17C, the photosensor 39*s* outputs an off signal because light is blocked by the light-shielding plate 39*d* and the photosensor 39*t* also outputs an off signal because light is blocked by the light-shielding plate 39*e*.

Figure 17D:
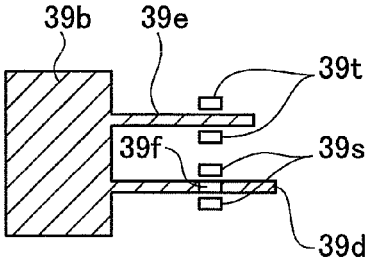

(D) In the fourth position in which the tension of the ink ribbon 35 is in the largest level, as shown in FIG. 17D, the photosensor 39*s* outputs an on signal because light is not blocked by the light-shielding plate 39*d* and the photosensor 39*t* outputs an off signal because light is blocked by the light-shielding plate 39*e*.

As described above, there are four combinations of the outputs (the on signal and off signal) of the two photosensors 39*s* and 39*t*, that is, (the combination of off signal and off signal), (the combination of the on signal and off signal), (the combination of the on signal and on signal) and (the combination of the off signal and on signal). According to the combinations, the tension levels in above-described (A) to (D) can be individually detected and the tension of the ink ribbon 35 can be carefully adjusted on the take-up side path.

The configuration and effects of the second ribbon tension detector 39 are same as those of the first ribbon tension detector 38. Thus, the tension of the ink ribbon 35 can be also carefully adjusted on the feeding side path.

The printer 100 according to the embodiment has been described as a label printer using an ink ribbon. However, the essential part of the present invention relating to the configuration for notifying that the remaining amount of paper becomes low is not limited to the printer of this embodiment. The present invention may be a printer using roll paper other than paper on which labels are affixed or may be a printer which does not use an ink ribbon.

Also, the printer of the present invention is not limited to a thermal printer but may be a dot impact printer or an ink-jet printer.

The printer according to the embodiment of the present invention does not need to provide a complex structure to the printer body and does not impair the operability of the printer when the paper holder is attached or detached with respect to the printer body.

Although the embodiment of the present disclosure has been described above, the present disclosure is not limited thereto. It should be appreciated that variations may be made in the embodiment described by persons skilled in the art without departing from the scope of the present disclosure.

What is claimed is:

1. A printer comprising:

a printer body;

a paper holder detachably mounted to said printer body, said paper holder including:

a shaft portion for supporting a roll of paper; and a movable member located in a predetermined vertical height position above a first end portion of said shaft portion, said movable member being configured to be linearly displaced in a direction parallel to a longitudinal axis of said shaft portion between a pressing position, in which said movable member contacts and presses against a first axial end surface of the roll of paper supported by said shaft portion, and a non-pressing position, in which said movable member is not in contact with the axial end surface of the roll of paper, said movable member being biased toward the non-pressing position;

a movable member detector configured to detect that said movable member is in the non-pressing position while said paper holder is attached to said printer body, said movable member detector to be arranged within said printer body; and a remaining amount notifier configured to indicate that a remaining amount of the roll of paper is low when said movable member detector detects that said movable member is in the non-pressing position.

2. The printer according to claim 1, further comprising a movable member height position adjusting mechanism configured to adjust a position of said movable member in a vertical direction.

3. The printer according to claim 1, further comprising a movable member holding mechanism configured to hold said movable member in the pressing position even if the roll of paper is not present on said shaft portion.

4. The printer according to claim 1, wherein said paper holder further includes:

a handle extending vertically upwards from said first end portion of said shaft portion, said handle having a finger rest portion with a tip end to be caught with a user's finger; and a paper width adjusting member having a finger rest portion with an upper tip end to be caught with a user's finger, and having a paper pressing surface configured to be pressed against a second axial end surface of the roll of paper substantially perpendicular to the longitudinal axis of said shaft portion, said paper pressing surface having a shaft hole formed therein through which said shaft portion extends;

wherein said paper width adjusting member is configured to be slidable along the longitudinal axis of said shaft portion by passing said shaft portion through said shaft hole from a second end portion of said shaft portion, and is detachable from said shaft portion.

5. The printer according to claim 1, further comprising a movable member height position adjusting mechanism including:

a stationary sleeve member having a vertical rail portion with ridges and recessed portions between said ridges; and a protruding member forming said movable member, said protruding member having a stop for engaging said recessed portions, said protruding member being configured to move in a vertical direction relative to said stationary sleeve member, and said stop of said protruding member being configured to engage any one of said recessed portions of said vertical rail portion so as to adjust a position of said movable member in the vertical direction.

6. The printer according to claim 1, further comprising a movable member holding mechanism including:

a handle extending vertically upwards from said first end portion of said shaft portion, said handle having a locking portion; and a projection on said movable member, said projection being configured to engage said locking portion of said handle when said movable member is in an uppermost pressing position so as to prevent said movable member from moving to said non-pressing position.

7. The printer according to claim 1, further comprising a spring for biasing said movable member towards said pressing position.

* * * * *